US011661238B2

(12) United States Patent
Kainz et al.

(10) Patent No.: US 11,661,238 B2
(45) Date of Patent: May 30, 2023

(54) COATED CONTAINER DEVICE, METHOD OF MAKING THE SAME

(71) Applicant: Dow Global Technologies LLC, Midland, MI (US)

(72) Inventors: Bernhard Kainz, Lauf (DE); Richard A. Lundgard, Midland, MI (US); David L. Malotky, Midland, MI (US); Jodi M. Mecca, Midland, MI (US); Charles F. Diehl, Blue Bell, PA (US); Ray E. Drumright, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 17/713,182

(22) Filed: Apr. 4, 2022

(65) Prior Publication Data

US 2022/0227536 A1 Jul. 21, 2022

Related U.S. Application Data

(63) Continuation of application No. 13/386,855, filed as application No. PCT/US2010/043086 on Jul. 23, 2010, now abandoned.

(60) Provisional application No. 61/228,366, filed on Jul. 24, 2009.

(51) Int. Cl.
*B65D 25/14* (2006.01)

(52) U.S. Cl.
CPC ..... *B65D 25/14* (2013.01); *B05D 2202/00* (2013.01); *B05D 2401/20* (2013.01); *B05D 2701/00* (2013.01)

(58) Field of Classification Search
CPC ..... B05D 2202/00; B05D 2401/20; B05D 2701/00
See application file for complete search history.

(56) References Cited

U.S. PATENT DOCUMENTS

| | | | |
|---|---|---|---|
| 2,898,233 | A | 8/1959 | Corwin |
| 3,645,992 | A | 2/1972 | Elston |
| 3,686,359 | A | 8/1972 | Soldtos et al. |
| 3,843,576 | A | 10/1974 | Parkinson |
| 4,009,317 | A | 2/1977 | Chase et al. |
| 4,066,628 | A | 1/1978 | Ashida et al. |
| 4,076,698 | A | 2/1978 | Anderson et al. |
| 4,438,254 | A | 3/1984 | Doorikan et al. |
| 4,480,082 | A | 10/1984 | McLean et al. |
| 4,599,392 | A | 7/1986 | McKinney et al. |
| 4,988,781 | A | 1/1991 | McKinney et al. |
| 5,073,578 | A | 12/1991 | Boodaghans et al. |
| 5,089,588 | A | 2/1992 | White et al. |
| 5,115,075 | A | 5/1992 | Brennan et al. |
| 5,164,426 | A | 11/1992 | Shimizu et al. |
| 5,171,820 | A | 12/1992 | Mang et al. |
| 5,246,751 | A | 9/1993 | White et al. |
| 5,272,236 | A | 12/1993 | Lai et al. |
| 5,278,272 | A | 1/1994 | Lai et al. |
| 5,527,616 | A | 6/1996 | Hatano et al. |
| 5,708,093 | A | 1/1998 | Bastelberger et al. |
| 6,420,469 | B1 | 7/2002 | Suda |
| 6,525,157 | B2 | 2/2003 | Cozewith et al. |
| 6,777,096 | B2 | 8/2004 | Shiba et al. |
| 6,960,635 | B2 | 11/2005 | Stevens et al. |
| 7,608,668 | B2 | 10/2009 | Li Pi Shan et al. |
| 9,221,940 | B2 | 12/2015 | Vyorykka et al. |
| 2005/0100754 | A1 | 5/2005 | Moncla et al. |
| 2006/0199930 | A1 | 9/2006 | Li Pi Shan et al. |
| 2007/0001413 | A1 | 1/2007 | Rossini |
| 2007/0002927 | A1 | 1/2007 | Finot |
| 2010/0003491 | A1 | 1/2010 | Crostic, Jr. |

FOREIGN PATENT DOCUMENTS

| | | |
|---|---|---|
| CN | 101054495 A | 10/2017 |
| GB | 1271572 A | 7/1969 |
| JP | 58037061 | 3/1983 |
| JP | 2009120642 | 6/2009 |
| WO | WO 0001745 | 1/2000 |
| WO | WO 2005090427 | 9/2005 |
| WO | WO2009/064942 | 5/2009 |
| WO | WO2009/067337 | 5/2009 |
| WO | WO20091064993 | 5/2009 |

*Primary Examiner* — Michael C Miggins

(57) ABSTRACT

The instant invention provides a coated container device, and method of making the same. The coated container device according to the instant invention comprises: (1) a metal substrate; and (2) one or more crosslinked coating layers associated with the metal substrate, wherein the one or more crosslinked coating layers are derived from the application of one or more aqueous dispersions to at least one surface of the metal substrate, and wherein the one or more aqueous dispersion comprise: (a) one or more a base polymer; (b) one or more a stabilizing agent; (c) optionally one or more neutralizing agents, (d) one or more crosslinking agents; and (e) water.

1 Claim, No Drawings

COATED CONTAINER DEVICE, METHOD OF MAKING THE SAME

CROSS-REFERENCE TO RELATED APPLICATIONS

This application is a continuation application to U.S. application Ser. No. 13/386,855, filed Jan. 24, 2012, which claims priority to PCT Application No. PCT/US2010/043086, filed Jul. 23, 2010, which claims priority to U.S. Provisional Patent Application No. 61/228,366, filed on Jul. 24, 2009, entitled "COATED CONTAINER DEVICE, METHOD OF MAKING THE SAME," the teachings of which are incorporated by reference herein, as if reproduced in full hereinbelow.

FIELD OF INVENTION

The instant invention relates to a coated container device, and method of making the same.

BACKGROUND OF THE INVENTION

The application of various treatment and pretreatment solutions to metals to retard or inhibit corrosion is well established. This is particularly true in the area of metal food and beverage cans as well as non-food metal containers. Coatings are applied to the interior of such containers to prevent the contents from contacting the metal of the container. Contact between the metal and the food or beverage as well as non-food substances can lead to corrosion of the metal container, which can then contaminate the food or beverage or the non-food contents of such metal containers. Corrosion is particularly problematic when food and beverage products are highly acidic nature and/or are having a high salt content such as a rhubarb-based products or isotonic drinks. Also strong alkaline contents of non-food substances such as hair-dye may react with metal such as aluminum. The coatings applied, for example, to the interior of food and beverage cans also helps prevent corrosion in the head space of the cans, which is the area between the fill line of the food product and the can lid. The coatings may be applied to the outside of metal containers to provide protection against the external environment or to provide a decorative layer including fillers and/or pigments. In addition to corrosion protection, coatings for food and beverage cans should be non-toxic and inert, and, if applied to the internal surface, should not adversely affect the taste or appearance, e.g. color, of the food or beverage in the can or contribute to a contamination of the contents of the can. Resistance to "popping", "blushing" and/or "blistering" is also desired. Certain coatings are particularly applicable for application onto coiled metal stock, such as the coiled metal stock from which the ends of cans are made, "can end stock" and valve cups, e.g. top ends of aerosol cans. Since coatings designed for use on can end stock are applied prior to the ends being cut and stamped out of the coiled metal stock, they are also typically flexible and/or extensible. For example, can end stock is typically coated on both sides. Thereafter, the coated metal stock is punched and may be beaded or bended. It may also be scored for the "pop-top" opening and the pop-top ring is then attached with a pin that is separately fabricated. The end is then attached to the can body by an edge rolling process. Accordingly, the coating applied to the can end stock typically has a certain degree of toughness and flexibility, such that it can withstand extensive fabrication processes, in addition to some or all of the other desirable features discussed above. Various coatings such as epoxy-based and polyvinyl chloride-based, e.g. organosol type, coatings have been used in the past to coat the interior of metal cans to prevent corrosion. However, there is a need for food and beverage can liners as well as non-food container liners that provide improved properties such as having resistance to degradation in corrosive media as well as appropriate level of flexibility.

SUMMARY OF THE INVENTION

The instant invention provides a coated container device, and method of making the same.

In one embodiment, the instant invention provides a coated container device comprising: (1) a metal substrate; and (2) one or more crosslinked coating layers associated with the metal substrate, wherein the one or more crosslinked coating layers are derived from the application of one or more aqueous dispersions to at least one surface of the metal substrate, and wherein the one or more aqueous dispersions comprise: (a) one or more base polymers; (b) one or more stabilizing agents; (c) optionally one or more neutralizing agents, (d) one or more crosslinking agents; and (e) water.

In an alternative embodiment, the instant invention further provides a method for making a coated container device comprising the steps of: (1) selecting a metal substrate; (2) selecting one or more aqueous dispersions comprising: (a) one or more base polymers; (b) one or more stabilizing agents; (c) optionally one or more neutralizing agents, (d) one or more crosslinking agents; and (e) water; (3) applying the one or more aqueous dispersions to at least one surface of said metal substrate; (4) removing at least a portion of the water from the one or more aqueous dispersions; (5) thereby forming one or more crosslinked coating layers associated with at least one surface of the metal substrate; and (6) forming the coated metal substrate into a coated container device.

In another alternative embodiment, the instant invention further provides a method for making a coated container device comprising the steps of: (1) selecting a metal substrate; (2) forming the metal into a container device; (3) selecting one or more aqueous dispersions comprising; (a) one or more base polymers; (b) one or more stabilizing agents; (c) optionally one or more neutralizing agents, (d) one or more crosslinking agents; and (e) water; and (4) applying the one or more aqueous dispersions to at least one surface of the container device; (5) removing at least a portion of the water from the one or more aqueous dispersions; (6) thereby forming one or more crosslinked coating layers associated with at least one surface of the container device; and (7) thereby forming the coated container device.

In an alternative embodiment, the instant invention provides a coated container device, a method for making a coated container device, in accordance with any of the preceding embodiments, except that the metal substrate is a pre-coated metal substrate.

In an alternative embodiment, the instant invention provides a coated container device, a method for making a coated container device, in accordance with any of the preceding embodiments, except that the one or more base polymers comprises one or more polyolefins.

In an alternative embodiment, the instant invention provides a coated container device, a method for making a coated container device, in accordance with any of the preceding embodiments, except that the one or more base polymers comprises one or more polyolefins selected from the group consisting of an ethylene base polymer and a propylene based polymer.

In an alternative embodiment, the instant invention provides a coated container device, a method for making a coated container device, in accordance with any of the preceding embodiments, except that the one or more base polymers comprises one or more polyolefins having a crystalline melting point of greater than 60° C.

In an alternative embodiment, the instant invention provides a coated container device, a method for making a coated container device, in accordance with any of the preceding embodiments, except that the one or more base polymers comprises one or more polyolefins having a crystalline melting point of greater than 90° C.

In an alternative embodiment, the instant invention provides a coated container device, a method for making a coated container device, in accordance with any of the preceding embodiments, except that the one or more base polymers comprises one or more polyolefins having a crystalline melting point of greater than 100° C.

In an alternative embodiment, the instant invention provides a coated container device, a method for making a coated container device, in accordance with any of the preceding embodiments, except that the one or more base polymers comprises one or more polyolefins having a crystalline melting point of greater than 120° C.

In an alternative embodiment, the instant invention provides a coated container device, a method for making a coated container device, in accordance with any of the preceding embodiments, except that the one or more base polymers comprises one or more polyolefins having a crystalline melting point of greater than 130° C.

DETAILED DESCRIPTION OF THE INVENTION

The instant invention provides a coated container device, and method of making the same.

The coated container device according to the present invention comprises: (1) a metal substrate; and (2) one or more crosslinked coating layers associated with the metal substrate, wherein the one or more crosslinked coating layers are derived from the application of one or more aqueous dispersions to at least one surface of the metal substrate, and wherein the one or more aqueous dispersions comprise: (a) one or more base polymers; (b) one or more stabilizing agents; (c) optionally one or more neutralizing agents, (d) one or more crosslinking agents; and (e) water.

The metal substrate comprises one or more metals including, but not limited to, aluminum and aluminum alloys, electrolytic tinplate cold rolled low carbon mild steel ("ETP"), electrolytic chromium/chromium oxide coated cold rolled low carbon mild steel (ECCS), and any other pre-treated steel. Pretreatment may include, but is not limited to, treatment with phosphoric acid, zirconium phosphate, chromium phosphate, and the like as well as silanes for reasons such as primary corrosion protection and improved adhesion. The metal substrate may comprise a sheet, strip or a coil. The metal substrate may comprise one or more layers, and each layer may have a thickness in the range of from 0.01 μm to 2 mm; for example, from 0.01 μm to 1.5 mm; or in the alternative, from 0.01 μm to 1 mm; or in the alternative, from 0.01 μm to 0.5 mm; or in the alternative, from 0.01 μm to 0.2 mm; or in the alternative, from 0.01 μm to 0.1 mm or in the alternative, from 0.01 μm to 100 μm; or in the alternative, from 0.01 μm to 50 μm; or in the alternative, from 1 μm to 50 μm; or in the alternative, from 1 μm to 15 μm. The substrate may be pre-coated with one or more pre-coating compositions. Such pre-coating compositions may optionally further include, but are not limited to, one or more resin binders, one or more resin crosslinkers, one or more solvents, one or more additives, and one or more pigments. Exemplary resin binders include, but are not limited to, epoxy, polyester, polyvinyl chloride containing organosols/vinyls, phenolic, alkyd, oleoresin, acrylic resin, and the like. Exemplary crosslinkers include, but are not limited to, phenol-formaldehyde resins; amino-formaldehyde resins including but not limited to urea-formaldehyde, melamine formaldehyde, benzoguanamine formaldehyde, anhydride resins, blocked isocyanate resins and epoxy groups containing resins, including but not limited to, epoxy resins, epoxy groups containing polyesters, acrylic resins, vinyl resins or the like. Exemplary solvents and thinners include, but are not limited to, glycol ethers, alcohols, aromatics, e.g. aromatic hydrocarbons, white spirit, branched ketones and esters. Exemplary additives include, but are not limited to, catalysts, lubricants, wetting agents, defoamers, flow agents, release agents, slip agents, anti-blocking agents, additives to mask sulfur staining, pigment wetting/dispersion agents, anti-settling agents, UV stabilizers, adhesion promoters. Pigments include, but are not limited to titanium dioxide, zinc oxide, aluminum oxide, zinc and aluminum. The substrate may also be pre-coated with one or more pre-coated laminate compositions. Such compositions may, for example, include polyethylene, polypropylene, or polyester compositions, and may be applied either as a film via film lamination process or melt-extrusion coating process onto the metal surface.

The one or more coating layers are derived from the application of one or more aqueous dispersions to at least one surface of the metal substrate. The one or more aqueous dispersions comprise the melt-blending product of one or more base polymers and one or more stabilizing agents and one or more crosslinking agents in the presence of water and optionally one or more neutralizing agents under controlled pressure and temperature conditions. In the alternative, the one or more aqueous dispersions comprise the melt-blending product of one or more base polymers and one or more stabilizing agents in the presence of water and optionally one or more neutralizing agents under controlled pressure and temperature conditions, and the post addition of one or more crosslinking agents.

Base Polymer

The aqueous dispersion comprises from 1 to 99 percent by weight of one or more base polymers based on the total weight of the solid content of the aqueous dispersion. All individual values and subranges from 1 to 99 weight percent are included herein and disclosed herein; for example, the weight percent can be from a lower limit of 1, 5, 8, 10, 15, 20, 25 weight percent to an upper limit of 40, 50, 60, 70, 80, 90, 95, or 99 weight percent. For example, the aqueous dispersion may comprise from 15 to 99, or from 15 to 90, or 15 to 80, or from 15 to 75, or from 30 to 70, or from 35 to 65 percent by weight of one or more base polymers, based on the total weight of the solid content of the aqueous dispersion. The aqueous dispersion comprises at least one or more base polymers.

The base polymer may, for example, be selected from the group consisting of a thermoplastic material, and a thermosetting material. The one or more base polymers may comprise one or more olefin based polymers, one or more acrylic based polymers, one or more polyester based polymers, one or more epoxy based polymers, one or more thermoplastic polyurethane polymers, one or more styrenic based polymers, one or more vinyl based copolymers, one or more polyamides, or combinations thereof.

In one embodiment, the one or more base polymers comprise one or more polyolefins. The one or more base polymers comprising one or more polyolefins may further include one or more non-polyolefin thermoplastic materials and/or one or more thermosetting materials. Such additional non-polyolefin base polymers include, but are not limited to, one or more acrylic based polymers, one or more polyester based polymers, one or more epoxy based polymers, one or more thermoplastic polyurethane polymers, one or more styrenic based polymers, one or more vinyl based copolymers, one or more polyamides, or combinations thereof.

Examples of the polyolefins include, but are not limited to, homopolymers and copolymers (including elastomers) of one or more alpha-olefins such as ethylene, propylene, 1-butene, 3-methyl-1-butene, 4-methyl-1-pentene, 3-methyl-1-pentene, 1-heptene, 1-hexene, 1-octene, 1-decene, and 1-dodecene, as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene, as typically represented by ethylene-butadiene copolymer and ethylene-ethylidene norbornene copolymer; and polyolefins (including elastomers) such as copolymers of two or more alpha-olefins with a conjugated or non-conjugated diene, as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymer, ethylene-vinyl alcohol copolymer, ethylene-vinyl chloride copolymer, ethylene acrylic acid or ethylene-(meth)acrylic acid copolymers, and ethylene-(meth)acrylate copolymer, In certain embodiments, one or more of the polyolefin base polymers may be functionalized polyolefins such as polypropylene or polyethylene homopolymer or copolymer in which the polymer has been modified with hydroxyl, amine, aldehyde, epoxide, ethoxylate, carboxylic acid, ester, or anhydride group. These functionalized polyolefins such as polypropylene or polyethylene homopolymers or copolymers are available, for example, from Baker Petrolite, a subsidiary of Baker Hughes, Inc.

Exemplary polyolefins include, but are not limited to, one or more thermoplastic polyolefin homopolymers or copolymers of one or more alpha-olefins such as ethylene, propylene, 1-butene, 3-methyl-1-butene, 4-methyl-1-pentene, 3-methyl-1-pentene, 1-heptene, 1-hexene, 1-octene, 1-decene, and 1-dodecene, as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer. Such exemplary polyolefins may have a molecular weight of greater than 800 grams/mole; for example, greater than 5,000 grams/mole; or in the alternative, greater than 50,000 grams/mole.

In one embodiment, the one or more polyolefins have crystalline melting point of greater than 60° C.; for example, greater than 95° C.; or in the alternative, greater than 100° C.; or in the alternative, greater than 120° C.; or in the alternative, greater than 130° C.

In one embodiment, at least one of the one or more base polymers comprises a thermoplastic polar polyolefin polymer, having a polar group as either a comonomer or grafted monomer. Exemplary polar polyolefins include, but are not limited to, maleic anhydride grafted polyethylene homopolymer or copolymer, maleic anhydride grafted polypropylene homopolymer or copolymer, ethylene-acrylic acid (EAA) and ethylene-methacrylic acid copolymers, such as those available under the trademarks PRIMACOR™, commercially available from The Dow Chemical Company, NUCREL™, commercially available from E.I. DuPont de Nemours, and ESCOR™, commercially available from ExxonMobil Chemical Company and described in U.S. Pat. Nos. 4,599,392, 4,988,781, and 5,938,437, each of which is incorporated herein by reference to the extent describing such polar polyolefins. Other exemplary polar polyolefins include, but are not limited to, ethylene ethyl acrylate (EEA) copolymer, ethylene methyl methacrylate (EMMA), and ethylene butyl acrylate (EBA).

In one embodiment, the polar polyolefin polymer is an ethylene-acrylic acid (EAA) or ethylene-methacrylic acid copolymer, which may be neutralized with one or more neutralizing agents, e.g. a base such as an alkali metal hydroxide, ammonia, or an organic amine, in the dispersion process.

Thermoplastic material may comprise non-polyolefin thermoplastic materials. Such non-polyolefin thermoplastic materials include polymers such as polystyrene, styrenic copolymers (including elastomers), ABS, acrylonitrile-styrene copolymer, α-methylstyrene-styrene copolymer, styrene vinyl alcohol, styrene acrylates such as styrene methylacrylate, styrene butyl acrylate, styrene butyl methacrylate, and styrene butadienes and crosslinked styrene polymers; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, copolymers of vinyl chloride with vinyl acetate, vinyl alcohol, maleic acid anhydride, hydroxyalkyl acrylate, glycidyl methacrylate and the like, polymethyl acrylate, and polymethyl methacrylate; polyamides such as nylon 6, nylon 6,6, and nylon 12; thermoplastic polyesters such as polyethylene terephthalate and polybutylene terephthalate and the like; epoxy resins such as polyhydroxy ethers, polyhydroxyaminoethers and polyhydroxy esters and the like, for example polyhydroxyether such as the reaction product of diglycidylether of bisphenol-A with bisphenol-A or the like, for example polyhydroxyaminoethers as the reaction product of diglycidylether of bisphenol-A with ethanol amine and polyhydroxyester such as the reaction product of diglycidylether of bisphenol-A with isophthalic acid or terephthalic acid and the like; polycarbonate, polyphenylene oxide, and the like; and glassy hydrocarbon-based resins, including poly-dicyclopentadiene polymers and related polymers (copolymers, terpolymers); esters of saturated acids with mono-olefinic alcohols such as vinyl acetate, vinyl propionate, vinyl versatate, and vinyl butyrate and the like; vinyl esters such as esters of unsaturated monocarboxylic acids, including methyl acrylate, ethyl acrylate, n-butyl acrylate, isobutyl acrylate, 2-ethylhexyl acrylate, glycidyl methacrylate, dodecyl acrylate, n-octyl acrylate, phenyl acrylate, methyl methacrylate, ethyl methacrylate, and butyl methacrylate and the like; acrylonitrile, methacrylonitrile, acrylamide, mixtures thereof, resins produced by ring opening metathesis and cross metathesis polymerization and the like. These resins may be used either alone or in combinations of two or more.

Exemplary (meth)acrylates, as base polymers, include, but are not limited to, methyl acrylate, ethyl acrylate, butyl acrylate, hexyl acrylate, 2-ethylhexyl acrylate, octyl acrylate and isooctyl acrylate, n-decyl acrylate, isodecyl acrylate, tert-butyl acrylate, methyl methacrylate, butyl methacrylate, hexyl methacrylate, isobutyl methacrylate, isopropyl methacrylate as well as 2-hydroxyethyl acrylate, 2-hydroxyethyl methacrylate, 2-hydroxypropyl acrylate, 2-hydroxypropyl, methacrylate, glycidyl methacrylate and acrylamide. The preferred (meth)acrylates include, but are not limited to, methyl acrylate, ethyl acrylate, butyl acrylate, 2-ethylhexyl acrylate, octyl acrylate, isooctyl acrylate, methyl methacrylate and butyl methacrylate 2-hydroxyethyl methacrylate, 2-hydroxypropyl methacrylate, acrylamide. Other suitable (meth)acrylates that can be polymerized from monomers include lower alkyl acrylates and methacrylates including acrylic and methacrylic ester monomers: methyl acrylate, ethyl acrylate, n-butyl acrylate, t-butyl acrylate, 2-ethylhexyl acrylate, decyl acrylate, isobornyl acrylate, methyl methacrylate, ethyl methacrylate, n-propyl methacrylate, isopropyl methacrylate, n-butyl methacrylate, isobutyl methacrylate, sec-butyl methacrylate, cyclohexyl methacrylate, isodecyl methacrylate, isobornyl methacrylate, t-butylaminoethyl methacrylate, stearyl methacrylate, glycidyl methacrylate, dicyclopentenyl methacrylate, phenyl methacrylate.

In selected embodiments, the base polymer may, for example, comprise one or more polyolefins selected from the group consisting of ethylene-alpha olefin copolymers, propylene-alpha olefin copolymers, and olefin block copolymers. In particular, in some embodiments, the base polymer may comprise one or more non-polar polyolefins.

In certain specific embodiments, polyolefins such as polypropylene, polyethylene, copolymers thereof, and blends thereof, as well as ethylene-propylene-diene terpolymers, may be used. In some embodiments, exemplary olefinic polymers include homogeneous polymers, as for example described in U.S. Pat. No. 3,645,992; high density polyethylene (HDPE), as for example described in U.S. Pat. No. 4,076,698; heterogeneously branched linear low density polyethylene (LLDPE); heterogeneously branched ultra low linear density polyethylene (ULDPE); homogeneously branched, linear ethylene/alpha-olefin copolymers; homogeneously branched, substantially linear ethylene/alpha-olefin polymers, which can be prepared, for example, by processes disclosed in U.S. Pat. Nos. 5,272,236 and 5,278,272, the disclosures of which are incorporated herein by reference; and high pressure, free radical polymerized ethylene polymers and copolymers such as low density polyethylene (LDPE) or ethylene vinyl acetate polymers (EVA).

In other particular embodiments, the base polymer may, for example, be ethylene vinyl acetate (EVA) based polymers. In other embodiments, the base polymer may, for example, be ethylene-methyl acrylate (EMA) based polymers. In other particular embodiments, the ethylene-alpha olefin copolymer may, for example, be ethylene-butene, ethylene-hexene, or ethylene-octene copolymers or interpolymers. In other particular embodiments, the propylene-alpha olefin copolymer may, for example, be a propylene-ethylene or a propylene-ethylene-butene copolymer or interpolymer.

In one particular embodiment, the base polymer may be a propylene/alpha-olefin copolymer, which is characterized as having substantially isotactic propylene sequences. "Substantially isotactic propylene sequences" means that the sequences have an isotactic triad (mm) measured by $^{13}C$ NMR of greater than about 0.85; in the alternative, greater than about 0.90; in another alternative, greater than about 0.92; and in another alternative, greater than about 0.93. Isotactic triads are well-known in the art and are described in, for example, U.S. Pat. No. 5,504,172 and International Publication No. WO 00/01745, which refer to the isotactic sequence in terms of a triad unit in the copolymer molecular chain determined by $^{13}C$ NMR spectra.

The propylene/alpha-olefin copolymer may have a crystallinity in the range of from at least 1 percent by weight (a heat of fusion of at least 2 Joules/gram) to 30 percent by weight (a heat of fusion of less than 50 Joules/gram). All individual values and subranges from 1 percent by weight (a heat of fusion of at least 2 Joules/gram) to 30 percent by weight (a heat of fusion of less than 50 Joules/gram) are included herein and disclosed herein; for example, the crystallinity can be from a lower limit of 1 percent by weight (a heat of fusion of at least 2 Joules/gram), 2.5 percent (a heat of fusion of at least 4 Joules/gram), or 3 percent (a heat of fusion of at least 5 Joules/gram) to an upper limit of 30 percent by weight (a heat of fusion of less than 50 Joules/gram), 24 percent by weight (a heat of fusion of less than 40 Joules/gram), 15 percent by weight (a heat of fusion of less than 24.8 Joules/gram) or 7 percent by weight (a heat of fusion of less than 11 Joules/gram). For example, the propylene/alpha-olefin copolymer may have a crystallinity in the range of from at least 1 percent by weight (a heat of fusion of at least 2 Joules/gram) to 24 percent by weight (a heat of fusion of less than 40 Joules/gram); or in the alternative, the propylene/alpha-olefin copolymer may have a crystallinity in the range of from at least 1 percent by weight (a heat of fusion of at least 2 Joules/gram) to 15 percent by weight (a heat of fusion of less than 24.8 Joules/gram); or in the alternative, the propylene/alpha-olefin copolymer may have a crystallinity in the range of from at least 1 percent by weight (a heat of fusion of at least 2 Joules/gram) to 7 percent by weight (a heat of fusion of less than 11 Joules/gram); or in the alternative, the propylene/alpha-olefin copolymer may have a crystallinity in the range of from at least 1 percent by weight (a heat of fusion of at least 2 Joules/gram) to 5 percent by weight (a heat of fusion of less than 8.3 Joules/gram). The crystallinity is measured via Differential scanning calorimetry (DSC) method. The propylene/alpha-olefin copolymer comprises units derived from propylene and polymeric units derived from one or more alpha-olefin comonomers. Exemplary comonomers utilized to manufacture the propylene/alpha-olefin copolymer are $C_2$, and $C_4$ to $C_{10}$ alpha-olefins; for example, $C_2$, $C_4$, $C_6$ and $C_8$ alpha-olefins. The propylene/alpha-olefin copolymer comprises from 1 to 40 percent by weight of units derived from one or more alpha-olefin comonomers. All individual values and subranges from 1 to 40 weight percent are included herein and disclosed herein; for example, the weight percent of units derived from one or more alpha-olefin comonomers can be from a lower limit of 1, 3, 4, 5, 7, or 9 weight percent to an upper limit of 40, 35, 30, 27, 20, 15, 12, or 9 weight percent. For example, the propylene/alpha-olefin copolymer comprises from 1 to 35 percent by weight of units derived from one or more alpha-olefin comonomers; or in the alternative, the propylene/alpha-olefin copolymer comprises from 1 to 30 percent by weight of units derived from one or more alpha-olefin comonomers; or in the alternative, the propylene/alpha-olefin copolymer comprises from 3 to 27 percent by weight of units derived from one or more alpha-olefin comonomers; or in the alternative, the propylene/alpha-olefin copolymer comprises from 3 to 20 percent by weight of units derived from one or more alpha-olefin comonomers; or in the alternative, the propylene/alpha-olefin copolymer comprises from 3 to 15 percent by weight of units derived from one or more alpha-olefin comonomers.

The propylene/alpha-olefin copolymer has a molecular weight distribution (MWD), defined as weight average molecular weight divided by number average molecular weight ($M_w/M_n$) of 3.5 or less; in the alternative 3.0 or less; or in another alternative from 1.8 to 3.0. Such propylene/alpha-olefin copolymers are further described in details in the U.S. Pat. Nos. 6,960,635 and 6,525,157, incorporated herein by reference. Such propylene/alpha-olefin copolymers are commercially available from The Dow Chemical Company, under the tradename VERSIFY™, or from ExxonMobil Chemical Company, under the tradename VISTAMAXX™.

In one embodiment, the propylene/alpha-olefin copolymers are further characterized as comprising (A) between 60 and less than 100, preferably between 80 and 99 and more preferably between 85 and 99, weight percent units derived from propylene, and (B) between greater than zero and 40, preferably between 1 and 20, more preferably between 4 and 16 and even more preferably between 4 and 15, weight percent units derived from at least one of ethylene and/or a $C_{4-10}$ α-olefin; and containing an average of at least 0.001, preferably an average of at least 0.005 and more preferably an average of at least 0.01, long chain branches/1000 total carbons, wherein the term long chain branch, as used herein, refers to a chain length of at least one (1) carbon more than a short chain branch, and short chain branch, as used herein, refers to a chain length of two (2) carbons less than the number of carbons in the comonomer. For example, a propylene/1-octene interpolymer has backbones with long chain branches of at least seven (7) carbons in length, but these backbones also have short chain branches of only six (6) carbons in length. The maximum number of long chain branches typically it does not exceed 3 long chain branches/1000 total carbons. Such propylene/alpha-olefin copolymers are further described in details in the U.S. Provisional Patent Application No. 60/988,999 and International Patent Application No. PCT/US08/082599, each of which is incorporated herein by reference.

In other selected embodiments, olefin block copolymers, e.g., ethylene multi-block copolymer, such as those described in the International Publication No. WO2005/090427 and U.S. Patent Application Publication No. US 2006/0199930, incorporated herein by reference to the extent describing such olefin block copolymers, may be used as the base polymer. Such olefin block copolymer may be an ethylene/α-olefin interpolymer:

(a) having a $M_w/M_n$ from about 1.7 to about 3.5, at least one melting point, $T_m$, in degrees Celsius, and a density, d, in grams/cubic centimeter, wherein the numerical values of $T_m$ and d corresponding to the relationship:

$$T_m > -2002.9 + 4538.5(d) - 2422.2(d)^2; \text{ or}$$

(b) having a $M_w/M_n$ from about 1.7 to about 3.5, and being characterized by a heat of fusion, ΔH in J/g, and a delta quantity, ΔT, in degrees Celsius defined as the temperature difference between the tallest DSC peak and the tallest CRYSTAF peak, wherein the numerical values of ΔT and ΔH having the following relationships:

$$\Delta T > -0.1299(\Delta H) + 62.81 \text{ for } \Delta H \text{ greater than zero and up to 130 J/g,}$$

$$\Delta T > 48^\circ \text{ C. for } \Delta H \text{ greater than 130 J/g,}$$

wherein the CRYSTAF peak being determined using at least 5 percent of the cumulative polymer, and if less than 5 percent of the polymer having an identifiable CRYSTAF peak, then the CRYSTAF temperature being 30° C.; or (c) being characterized by an elastic recovery, Re, in percent at 300 percent strain and 1 cycle measured with a compression-molded film of the ethylene/α-olefin interpolymer, and having a density, d, in grams/cubic centimeter, wherein the numerical values of Re and d satisfying the following relationship when ethylene/α-olefin interpolymer being substantially free of a cross-linked phase:

$$Re > 1481 - 1629(d); \text{ or}$$

(d) having a molecular fraction which elutes between 40° C. and 130° C. when fractionated using TREF, characterized in that the fraction having a molar comonomer content of at least 5 percent higher than that of a comparable random ethylene interpolymer fraction eluting between the same temperatures, wherein said comparable random ethylene interpolymer having the same comonomer(s) and having a melt index, density, and molar comonomer content (based on the whole polymer) within 10 percent of that of the ethylene/α-olefin interpolymer; or (e) having a storage modulus at 25° C., G' (25° C.), and a storage modulus at 100° C., G' (100° C.), wherein the ratio of G' (25° C.) to G' (100° C.) being in the range of about 1:1 to about 9:1.

Such olefin block copolymer, e.g. ethylene/α-olefin interpolymer may also:

(a) have a molecular fraction which elutes between 40° C. and 130° C. when fractionated using TREF, characterized in that the fraction having a block index of at least 0.5 and up to about 1 and a molecular weight distribution, $M_w/M_n$, greater than about 1.3; or (b) have an average block index greater than zero and up to about 1.0 and a molecular weight distribution, $M_w/M_n$, greater than about 1.3.

In certain embodiments, the base polymer may, for example, comprise a polar polymer, having a polar group as either a comonomer or grafted monomer. In exemplary embodiments, the base polymer may, for example, comprise one or more polar polyolefins, having a polar group as either a comonomer or grafted monomer. Exemplary polar polyolefins include, but are not limited to, ethylene-acrylic acid (EAA) and ethylene-methacrylic acid copolymers, such as those available under the trademarks PRIMACOR™, commercially available from The Dow Chemical Company, NUCREL™, commercially available from E.I. DuPont de Nemours, and ESCOR™, commercially available from ExxonMobil Chemical Company and described in U.S. Pat. Nos. 4,599,392, 4,988,781, and 5,938,437, each of which is incorporated herein by reference in its entirety. Other exemplary base polymers include, but are not limited to, ethylene ethyl acrylate (EEA) copolymer, ethylene methyl methacrylate (EMMA), and ethylene butyl acrylate (EBA).

Other ethylene-carboxylic acid copolymer may also be used. The one or more base polymers could also derived by chemical modification of the functional acid group in the one or more polar polymers to form hydroxyl ester groups or to an amide and the like. Those having ordinary skill in the art will recognize that a number of other useful polymers may also be used. Another base polymer might include copolymers as ethylene vinyl alcohol and ethylene vinyl acetate and the like.

In one embodiment, the base polymer may, for example, comprise a polar polyolefin selected from the group consisting of ethylene-acrylic acid (EAA) copolymer, ethylene-methacrylic acid copolymer, and combinations thereof, and the stabilizing agent may, for example, comprise a polar polyolefin selected from the group consisting of ethylene-acrylic acid (EAA) copolymer, ethylene-methacrylic acid copolymer, and combinations thereof, provided, however, that base polymer may, for example, have a lower acid number, measured according to ASTM D-974, than the stabilizing agent.

In certain embodiments, the base polymer may, for example, comprise a polyester resin. Polyester resin refers to thermoplastic or thermosetting resins that may include polymers containing at least one ester bond. They can be hydroxyl functional or carboxyl functional. For example, polyester may be prepared via a conventional esterification process using a molar excess of an aliphatic diol or glycol with relation to a polycarboxylic acid or anhydride thereof. Triols or polyols can be used to provide branched polyesters.

Illustrative of the glycols, triols and polyols that can be employed to prepare the polyesters include, but are not limited to ethylene glycol, diethylene glycol, triethylene glycol and higher polyethylene glycols, propylene glycol, dipropylene glycol, tripropylene glycol and higher polypropylene glycols, 1,3-propanediol, 1,4-butanediol and other butanediols, 1,5-pentanediol and other pentane diols, hexanediols, decanediols, and dodecanediols, glycerol, trimethylolpropane, trimethylolethane, neopentyl glycol, pentaerythritol, cyclohexanedimethanol, a polyethylene or polypropylene glycol having an mw of about 500 or less, isopropylidene bis (p-phenylene-oxypropanol-2), and mixtures thereof. In some embodiments, the aliphatic glycol may contain from 2 to about 8 carbon atoms.

Illustrative of the polycarboxylic acids or anhydrides, that may be used to prepare the polyesters include, but are not limited to maleic acid, maleic anhydride, malonic acid, fumaric acid, succinic acid, succinic anhydride, glutaric acid, adipic acid, 2-methyl-1,6-hexanoic acid, pimelic acid, suberic acid, dodecanedioic acids, phthalic acid, phthalic anhydride, 5-tert butyl isophthalic acid, tetrahydrophthalic anhydride, hexahydrophthalic acid, hexahydrophthalic anhydride, endomethylenetetrahydrophthalic anhydride, azelaic acid, sebacic acid, tetrachloro-phthalic anhydride, chlorendic acid, isophthalic acid, trimellitic anhydride, terephthalic acid, naphthalene dicarboxylic acid, cyclohexanedicarboxylic acid, and mixtures thereof. In some embodiments, the alkanedioic acids may contain from 4 to 12 carbon atoms. It is also understood that an esterifiable derivative of a polycarboxylic acid, such as a dimethyl ester or anhydride of a polycarboxylic acid, can be used to prepare the polyester.

Other embodiments of the present invention use polyester resins containing aliphatic diols such as UNOXOL™ (a mixture of cis and trans 1,3- and 1,4-cyclohexanedimethanol) available from The Dow Chemical Company (Midland, Mich.).

In certain embodiments, base polymer may, for example, comprise a thermosetting material comprising an epoxy resin. Epoxy resin refers to a composition which possesses one or more vicinal epoxy groups per molecule, i.e. at least one 1,2-epoxy group per molecule. In general, such compound is a saturated or unsaturated aliphatic, cycloaliphatic, aromatic or heterocyclic compound which possesses at least one 1,2-epoxy group. Such compound can be substituted, if desired, with one or more non-interfering substituents, such as halogen atoms, hydroxy groups, ether radicals, lower alkyls and the like. Also one or more epoxy containing substance can be combined in making the desired epoxy resin.

Illustrative epoxies are described in the *Handbook of Epoxy Resins* by H. E. Lee and K. Neville published in 1967 by McGraw-Hill, New York and U.S. Pat. No. 4,066,628, incorporated herein by reference.

Particularly useful compounds which can be used in the practice of the present invention are epoxy resins having the following formula:

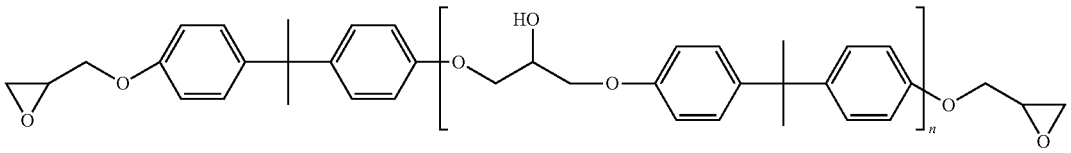

wherein n has an average value of 0 or more.

The epoxy resins useful in the present invention may include, for example, the glycidyl polyethers of polyhydric phenols and polyhydric alcohols. As an illustration of the present invention, examples of known epoxy resins that may be used in the present invention, include for example, the diglycidyl ethers of resorcinol, catechol, hydroquinone, biphenol, bisphenol A, bisphenol AP (1,1-bis(4-hydroxylphenyl)-1-phenyl ethane), bisphenol F, bisphenol K, bisphenol S, tetrabromobisphenol A, phenol-formaldehyde novolac resins, alkyl substituted phenol-formaldehyde resins, phenol-hydroxybenzaldehyde resins, cresol-hydroxybenzaldehyde resins, dicyclopentadiene-phenol resins, dicyclopentadiene-substituted phenol resins tetramethylbiphenol, tetramethyl-tetrabromobiphenol, tetramethyltribromobiphenol, tetrachlorobisphenol A and any combination thereof.

Examples of diepoxides particularly useful in the present invention include diglycidyl ether of 2,2-bis(4-hydroxyphenyl) propane (generally referred to as bisphenol A) and diglycidyl ether of 2,2-bis(3,5-dibromo-4-hydroxyphenyl) propane (generally referred to as tetrabromobisphenol A). Mixtures of any two or more polyepoxides can also be used in the practice of the present invention.

Other exemplary diepoxides include the diglycidyl ethers of dihydric phenols, such as those described in U.S. Pat. Nos. 5,246,751; 5,115,075; 5,089,588; 4,480, 082 and 4, 438,254, all of which are incorporated herein by reference, or the diglycidyl esters of dicarboxylic acids such as those described in U.S. Pat. No. 5,171,820. Other exemplary diepoxides include for example, αω-diglycidyloxyisopropylidene-bisphenol-based epoxy resins (commercially known as D.E.R.® 300 and 600 series epoxy resins, products of The Dow Chemical Company, Midland, Mich.).

The epoxy resins which can be employed in the practice of the present invention also include epoxy resins prepared either by reaction of diglycidyl ethers of dihydric phenols with dihydric phenols or by reaction of dihydric phenols with epichlorohydrin (also known as "taffy resins").

Exemplary epoxy resins include, for example, the diglycidyl ethers of bisphenol A; 4,4'-sulfonyldiphenol; 4,4-oxydiphenol; 4,4'-dihydroxybenzophenone; resorcinol; hydroquinone; catechol; 9,9'-bis(4-hydroxyphenyl)fluorene; 4,4'-dihydroxybiphenyl or 4, 4'-dihydroxy-α-methylstilbene and the diglycidyl esters of the dicarboxylic acids.

Other useful epoxide compounds include aliphatic epoxides such as polypropylene glycol diglycidyl ether, dipropylene glycol diglycidyl ether, 1,4 butanediol digylcidyl ether, neopentylglycol digylcidyl ether, 1,6 hexanediol diglycidyl ether, cyclohexanedimethanol diglycidylether, trimethylolpropane triglycidyl ether, glycerol triglycidylether or the like.

Other useful epoxide compounds include cycloaliphatic epoxides. A cycloaliphatic epoxide consists of a saturated carbon ring having an epoxy oxygen bonded to two vicinal atoms in the carbon ring for example as illustrated by the following general formula:

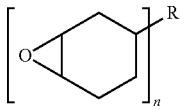

wherein R is a hydrocarbon group optionally comprising one or more heteroatoms (such as, without limitation thereto Cl, Br, and S), or an atom or group of atoms forming a stable bond with carbon (such as, without limitation thereto, Si, P and B) and wherein n is greater than or equal to 1.

The cycloaliphatic epoxide may be a monoepoxide, a diepoxide, a polyepoxide, or a mixture of those. For example, any of the cycloaliphatic epoxide described in U.S. Pat. No. 3,686,359, incorporated herein by reference, may be used in the present invention. As an illustration, the cycloaliphatic epoxides that may be used in the present invention include, for example, (3,4-epoxycyclohexylmethyl)-3,4-epoxy-cyclohexane carboxylate, bis-(3,4-epoxycyclohexyl) adipate, vinylcyclohexene monoxide and mixtures thereof.

In certain embodiments, the base polymer may, for example, comprise a thermosetting material comprising a modified epoxy resin which has been generated by co-reacting one of the aforementioned epoxy resins with a dioic acid such as, but not limited to adipic acid, 2-methyl-1,6-hexanoic acid, pimelic acid, suberic acid, dodecanedioic acids, phthalic acid, 5-tert butyl isophthalic acid, hexahydrophthalic acid, azelaic acid, sebacic acid, isophthalic acid, terephthalic acid, naphthalene dicarboxylic acid, cyclohexane-dicarboxylic acid, and mixtures thereof.

In certain embodiments, the base polymer may, for example, comprise a thermosetting material comprising a modified epoxy resin. Modifications could be originated by reaction of the terminal epoxy groups of the epoxy resin with a nucleophilic group containing substance such as a carboxylic group, phenolic hydroxyl, alkyl or glycolic hydroxyl, thiol, amine group or the like. It may be also the reaction product of the aforementioned epoxy group with an acid such as phosphoric acid, hydrogen chloride, hydrogen bromide, or the like. It may also be the reaction product of the aforementioned epoxy group with water or a phenolic compound such as bisphenol-A. It may also be the reaction product of the aforementioned epoxy group with an acid functional polyester resin.

In certain embodiments, the base polymer may, for example, comprise a thermoplastic or thermosetting polyurethane polymer. Such polyurethane polymers are generally known, and further described, for example, in the International Publication No. 2008/057878, incorporated herein by reference to the extent that it describes a thermoplastic polyurethane polymer.

Those having ordinary skill in the art will recognize that the above list is a non-comprehensive listing of exemplary base polymers. It will be appreciated that the scope of the present invention is restricted by the claims only.

In certain embodiments base polymer comprises of a thermoplastic polyamide. Such polyamide polymers are generally known for example, nylon 66, nylon 6, nylon 610, and nylon 11, nylon 12 and the like.

Stabilizing Agent

The aqueous dispersion may further comprise at least one or more stabilizing agents to promote the formation of a stable dispersion. The stabilizing agent may preferably be an external stabilizing agent. The dispersion of the instant invention comprises 1 to 50 percent by weight of one or more stabilizing agents, based on the total weight of the solid content of the dispersion. All individual values and subranges from 1 to 45 weight percent are included herein and disclosed herein; for example, the weight percent can be from a lower limit of 1, 3, 5, 10 weight percent to an upper limit of 15, 25, 35, 45, or 50 weight percent. For example, the dispersion may comprise from 1 to 25; or in the alternative, from 1 to 35; or in the alternative, from 1 to 40; or in the alternative, from 1 to 45 percent by weight of one or more stabilizing agents, based on the total weight of the solid content of the dispersion. In selected embodiments, the stabilizing agent may be a surfactant, a polymer, or mixtures thereof. In certain embodiments, the stabilizing agent can be a polar polymer, having a polar group as either a comonomer or grafted monomer. In exemplary embodiments, the stabilizing agent comprises one or more polar polyolefins, having a polar group as either a comonomer or grafted monomer. Exemplary polymeric stabilizing agents include, but are not limited to, ethylene-acrylic acid (EAA) and ethylene-methacrylic acid copolymers, such as those available under the trademarks PRIMACOR™, commercially available from The Dow Chemical Company, NUCREL™, commercially available from E.I. DuPont de Nemours, and ESCOR™, commercially available from ExxonMobil Chemical Company and described in U.S. Pat. Nos. 4,599,392, 4,988,781, and 5,938,437, each of which is incorporated herein by reference in its entirety. Other exemplary polymeric stabilizing agents include, but are not limited to, ethylene ethyl acrylate (EEA) copolymer, ethylene methyl methacrylate (EMMA), and ethylene butyl acrylate (EBA). Other ethylene-carboxylic acid copolymer may also be used. Those having ordinary skill in the art will recognize that a number of other useful polymers may also be used.

In certain embodiments, the stabilizing agent may be a functionalized polyolefin such as polypropylene or polyethylene homopolymer or copolymer in which the polymer has been modified with hydroxyl, amine, aldehyde, epoxide, ethoxylate, carboxylic acid, ester, or anhydride groups. These functionalized polyolefins such as polypropylene or polyethylene homopolymers and copolymers are available, for example, from Clariant Corporation under the tradenames LICOCENE 4351 and LICOCENE 6452, and from Baker Petrolite, a subsidiary of Baker Hughes, Inc.

Other stabilizing agents that may be used include, but are not limited to, long chain fatty acids, fatty acid salts, or fatty acid alkyl esters having from 12 to 60 carbon atoms. In other embodiments, the long chain fatty acid or fatty acid salt may have from 12 to 40 carbon atoms.

Additional stabilizing agents that may be useful in the practice of the present invention include, but are not limited to, cationic surfactants, anionic surfactants, or non-ionic surfactants. Examples of anionic surfactants include, but are not limited to, sulfonates, carboxylates, and phosphates. Examples of cationic surfactants include, but are not limited to, quaternary amines. Examples of non-ionic surfactants include, but are not limited to, block copolymers containing ethylene oxide and silicone surfactants. Stabilizing agents useful in the practice of the present invention can be either external surfactants or internal surfactants. External surfactants are surfactants that do not become chemically reacted into the base polymer during dispersion preparation. Examples of external surfactants useful herein include, but are not limited to, salts of dodecyl benzene sulfonic acid and lauryl sulfonic acid salt. Internal surfactants are surfactants that do become chemically reacted into the base polymer during dispersion preparation. An example of an internal surfactant useful herein includes 2,2-dimethylol propionic acid and its salts. Additional surfactants that may be useful in the practice of the present invention include cationic surfactants, anionic surfactants, non-ionic surfactants, or combinations thereof. Various commercially available surfactants may be used in embodiments disclosed herein, including: OP-100 (a sodium stearate), OPK-1000 (a potassium stearate), and OPK-181 (a potassium oleate), each available from RTD Hallstar; UNICID 350, available from Baker Petrolite; DISPONIL FES 77-IS and DISPONIL TA-430, each available from Cognis; RHODAPEX CO-436, SOPROPHOR 4D384, 3D-33, and 796/P, RHODACAL BX-78 and LDS-22, RHODAFAC RE-610, and RM-710, and SUPRAGIL MNS/90, each available from Rhodia; and TRITON QS-15, TRITON W-30, DOWFAX 2A1, DOWFAX 3B2, DOWFAX 8390, DOWFAX C6L, TRITON X-200, TRITON XN-45S, TRITON H-55, TRITON GR-5M, TRITON BG-10, and TRITON CG-110, each available from The Dow Chemical Company, Midland, Mich.

Additional stabilizing agents which could be used are solution or suspension polymers consisting of ethylenically unsaturated monomers such as acrylic and/or methacrylic acid and their ($C_1$-$C_{30}$) esters or amides; acrylamide/methacrylamide and their N-substituted derivatives; acrylonitrile; styrene and substituted styrene derivatives.

Exemplary polymeric stabilizing agents include, but are not limited to, amphiphilic copolymer compositions, the copolymer comprising the reaction product of (i) from 5 to 95 wt. % of one or more hydrophilic monomers and (ii) from 5 to 95 wt. % of one or more copolymerizable ethylenically unsaturated hydrophobic monomers. These materials are water soluble or emulsifiable, especially upon neutralization and can act as colloidal stabilizers. Exemplary stabilizing agents, for example, include, but are not limited to, butylacrylate and laurylmethacrylate.

Representative nonionic, water-soluble monomers suitable for production of amphiphilic copolymer compositions, include, but are not limited to, acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, t-butylacrylamide, N methylolacrylamide, alkyl(meth)acrylates such as methyl(meth)acrylate, butyl acrylate and ethylacrylate, vinyl monomers such as ethylene, styrene, divinylbenzene, di-isobutylethylene, vinyl acetate and N-vinyl pyrrolidone, and allyl monomers such as allyl (meth)acrylate.

Representative cationic, water-soluble monomers suitable for production of amphiphilic copolymer compositions include, but are not limited to, quaternary ammonium salts of amine functionalized monomers such as acrylamide, methacrylamide, N,N-dimethylacrylamide, N,N-diethylacrylamide, N-isopropylacrylamide, N-vinylformamide, N-vinylmethylacetamide, N-vinyl pyrrolidone, t-butylacrylamide, N-methylolacrylamide, tributylammonium ethyl (meth)acrylate TBAEMA, DMAEMA, DMAPMAM, diallyldimethylammonium chloride (DADMAC), methylacrylamidopropyltrimethylammonium chloride (MAPTAC), acrylamidopropyltrimethylammonium chloride (APTAC), N-vinyl pyrrolidone, vinylimidazole, polyquaternium-11 and polyquaternium-4.

"Anionic" or "acid-containing monomer" suitable for production of amphiphilic copolymer compositions include, but are not limited to, ethylenically unsaturated monomers containing carboxylic acid, phosphonic acid, phosphinic acid, sulfinic acid and sulfonic acid groups. Suitable examples include (meth)acrylic acid, maleic acid, succinic acid, itaconic acid, vinyl phosphonic acid and vinylsulfonic acid.

In an alternative embodiment, one or more stabilizing agents may be based on resins such as polyester, epoxy resins, polyamide resins, which might be reacted with acrylic resins or acrylic monomers to form polyester acrylate, polyamide acrylates epoxy resin acrylates.

Suitable polyester resins for producing stabilizing agents may be obtained in accordance with conventional procedures well known to those of ordinary skill in the art by reacting, for example, a polybasic acid that contains at least two carboxyl groups per polybasic acid molecule (e.g. an at least dibasic polycarboxylic acid) with a polyhydric alcohol that contains at least two hydroxyl groups in the polyhydric alcohol (e.g., at least dihydric alcohol) in presence of a conventional esterification catalyst at an elevated temperature with or without solvent present. Alternatively alkyl esters of the polycarboxylic acids can be reacted in presence of a conventional esterification catalyst at an elevated temperature. One or more polymerizable double bonds may be included into the polyester by employing a polybasic acid that contains polymerizable double bonds and/or a polyhydric alcohol that contains polymerizable double bonds.

Polyester acrylates as stabilizing agents may be formed via in-situ polymerization of copolymerizable ethylenically unsaturated monomers in presence of polyesters. Examples include ethylenically unsaturated mono- or polyfunctional acids, ethylenically unsaturated mono- or polyfunctional acid esters, amides, nitriles as well as vinyl monomers and vinyl ester with a polyester in or without presence of a reaction fluid. Polyester acrylates in solvents can be dried according to suitable methods known to those of ordinary skill in the art.

Suitable epoxy resins for producing stabilizing agents may be obtained in accordance with conventional procedures well known to those of ordinary skill in the art by reacting a polyepoxide with a suitable polynucleophile. Suitable epoxides include, but are not limited to, glycidyl ethers, and other epoxy group containing molecules. Suitable polynucleophiles include, but are not limited to, polyhydric phenols, and poly phenols, polythiols, aliphatic polyalcohols or polybasic acids or polyamines. Exemplary suitable epoxies, for example, include, but are not limited to, glycidyl ether that contains at least two glycidyl ether groups per polyglycidyl ether molecule (e.g. an at least diglycidyl ether) with a polyhydric phenol that contains at least two hydroxyl groups in the polyhydric polyphenol (e.g., at least dihydric phenol or a diphenol) in presence of a conventional catalyst at an elevated temperature with or without solvent present. Another class of epoxy resins may be obtained in accordance with conventional procedures well known to those of ordinary skill in the art by reacting, for example, a polyglycidyl ether that contains at least two glycidyl ether groups per polyglycidyl ether molecule (e.g. an at least diglycidyl ether) with a polybasic acid that contains at least two carboxyl groups per polybasic acid molecule (e.g. an at least dibasic polycarboxylic acid) in presence of a conventional catalyst at an elevated temperature with or without solvent present.

Epoxy acrylates for producing stabilizing agents may be formed via in-situ polymerization of copolymerizable ethylenically unsaturated monomers in presence of epoxy resins. Examples include, but are not limited to, ethylenically unsaturated mono- or polyfunctional acids, ethylenically unsaturated mono- or polyfunctional acid esters, amides, nitriles as well as vinyl monomers and vinyl ester with an epoxy resins in or without presence of a reaction fluid. Alternatively a polymeric acid functional acrylic resin can be reacted with an epoxy resin in the presence of a suitable catalyst to form epoxy acrylate. Epoxy acrylates in solvents can be dried according to suitable methods known to those of ordinary skill in the art.

Neutralizing Agent

The stabilizing agent may be partially or fully neutralized with a neutralizing agent. In certain embodiments, neutralization of the stabilizing agent, such as a long chain fatty acid or EAA, may be from 25 to 200 percent on a molar basis; or in the alternative, it may be from 50 to 150 percent on a molar basis; or in the alternative, it may be from 50 to 120 percent on a molar basis; or in the alternative, it may be from 50 to 110 percent on a molar basis. For example, for EAA, the neutralizing agent may be a base, such as ammonium hydroxide or potassium hydroxide, for example. Other neutralizing agents can include lithium hydroxide or sodium hydroxide, for example. In another alternative, the neutralizing agent may, for example, be a carbonate. In another alternative, the neutralizing agent may, for example, be any amine such as monoethanolamine, or 2-amino-2-methyl-1-propanol (AMP). Amines useful in embodiments disclosed herein may include diethanolamine, triethanolamine, and TRIS AMINO™ (each available from Angus), NEUTROL™ TE (available from BASF), as well as triisopropanolamine, diisopropanolamine, and N,N-dimethylethanolamine (each available from The Dow Chemical Company, Midland, Mich.). Other useful amines may include ammonia, monomethylamine, dimethylamine, trimethylamine, monoethylamine, diethylamine, triethylamine, mono-n-propylamine, butylamine, dibutylamine, tributylamine, dimethyl benzyl amine, dimethyl n-propylamine, N-methanol amine, N-aminoethylethanolamine, N-methyldiethanolamine, monoisopropanolamine, N,N-dimethyl propanolamine, 2-amino-2-methyl-1-propanol, 1,2-diaminopropane, tris(hydroxymethyl)-aminomethane, ethylenediamine N,N,N'N'-tetrakis(2-hydroxylpropyl) ethylenediamine, N,N,N',N' tetramethylpropanediamine, 3-methoxypropyl amine, imino bis-propyl amine and the like. In some embodiments, mixtures of amines or mixtures of amines and surfactants may be used. In one embodiment, the neutralizing agent may be a polymeric amine, e.g. diethylene triamine. Those having ordinary skill in the art will appreciate that the selection of an appropriate neutralizing agent depends on the specific composition formulated, and that such a choice is within the knowledge of those of ordinary skill in the art. In one embodiment, amines with boiling points below 250° C. may be used as the neutralizing agents.

Fluid Medium

The aqueous dispersion further comprises a fluid medium. The fluid medium may be any medium; for example, the fluid medium may be water. The dispersion of the instant invention comprises 15 to 99 percent by volume of water, or in the alternative, a mixture of water and one or more organic solvents, e.g. one or more water miscible solvents, one or more water immiscible solvents, or combinations thereof, based on the total volume of the dispersion. In particular embodiments, the water content may be in the range of from 30 to 75, or in the alternative from 35 to 65, or in the alternative from 40 to 60 percent by volume, based on the total volume of the dispersion. Water content of the dispersion may preferably be controlled so that the solids content (one or more base polymers plus stabilizing agent) is between about 1 percent to about 99 percent by volume. In particular embodiments, the solids range may be between about 15 percent and about 25 percent. In other particular embodiments, the solids range may be between 25 percent to about 70 percent by volume. In other particular embodiments, the solids range is between about 35 percent to about 65 percent by volume. In certain other embodiments, the solids range is between about 40 percent to about 60 percent by volume.

Additional Components

The aqueous dispersion of the present invention may optionally be blended with one or more binder compositions such as acrylic latex, vinyl acrylic latex, styrene acrylic latex, vinyl acetate ethylene latex, and combinations thereof; optionally one or more fillers; optionally one or more additives such as catalysts, wetting agents, defoamers, flow agents, release agents, slip agents, anti-blocking agents, additives to mask sulfur staining, pigment wetting/dispersion agents, anti-settling agents, UV stabilizers, adhesion promoters; optionally one or more lubricants such as fatty acid ester wax, silicon-based wax, fluorine-based wax, polyethylene or any other similar polyolefin wax, carnauba wax, lanolin wax or the like; optionally one or more corrosion inhibitors such as aluminum, and zinc: optionally one or more pigments, e.g. titanium dioxide, barium sulfate, mica, calcium carbonate, silica, zinc oxide, milled glass, aluminum trihydrate, talc, antimony trioxide, fly ash, and clay or the like; optionally one or more co-solvents, e.g. glycols, glycol ether, 2,2,4-trimethyl-1,3-pentanediol monoisobutyrate, alcohols, mineral spirits, aromatic solvents and benzoate esters or the like; optionally one or more dispersants, e.g. aminoalcohols, and polycarboxylates; optionally one or more surfactants; optionally one or more preservatives, e.g. biocides, mildewcides, fungicides, algaecides, and combinations thereof, optionally one or more thickeners, e.g. cellulosic based thickeners such as hydroxyethyl cellulose, hydrophobically modified alkali soluble emulsions (HASE thickeners such as UCAR POLYPHOBE TR-116) and hydrophobically modified ethoxylated urethane thickeners (HEUR); or optionally one or more additional neutralizing agents, e.g. hydroxides, amines, ammonia, and carbonates; optionally one or more solvents or coalescing agents.

In addition, the aqueous dispersion may be blended with one or more dispersions, emulsions, suspensions, colloidal suspensions, and the like.

Crosslinking Agent

The aqueous dispersion may further comprise at least one or more crosslinking agents to promote crosslinking. The aqueous dispersion of the instant invention comprises 1 to 50 percent by weight of one or more crosslinking agents, based on the total weight of the solid content of the dispersion. All individual values and subranges from 1 to 50 weight percent are included herein and disclosed herein; for example, the weight percent can be from a lower limit of 1, 3, 5, 10, 15, 20 weight percent to an upper limit of 10, 12, 15, 18, 20, 25, 30, 35, 40, 45, or 50 weight percent. For example, the dispersion may comprise from 1 to 18; or in the alternative, from 1 to 15; or in the alternative, from 1 to 12; or in the alternative, from 1 to 10; or in the alternative, from 1 to 20; or in the alternative, from 1 to 30; or in the alternative, from 1 to 40; or in the alternative, from 1 to 45; or in the alternative, from 1 to 50 percent by weight of one or more crosslinking agents, based on the total weight of the solid content of the dispersion. In selected embodiments the crosslinking agent may be, but is not limited to, phenol-formaldehyde resins, amino-formaldehyde resins including but not limited to urea-formaldehyde resins, melamine formaldehyde resins, benzoguanamine formaldehyde resins, anhydride resins, epoxy group containing resins, including but not limited to epoxy resins, epoxy group containing polyester or acrylic resins and blocked isocyanate resins, and combinations of two or more thereof, provided that the combinations of such crosslinkers is compatible.

Crosslinking agent may be a compound, which reacts with a reactive functional group contained in the dispersion formulation; thereby facilitating their crosslinking. Such functional groups can be present in both the base polymer as well as the stabilizing agent.

For example, reactive functional groups include, but are not limited to, acid groups such as carboxylic acid groups, free or in the neutralized form, or any functional groups having another active hydrogen by another component such as alcohol groups, amino groups, epoxy groups, or the like.

Crosslinkable functional groups in the cross-linking agent are groups capable of reacting with the reactive functional group of the base polymer or the stabilizer. For example, a carbodiimide group, an oxazoline group, an isocyanate group, an epoxy group, a methylol group, an aldehyde group, an acid anhydride group, a hydroxy group, an aziridinyl group or a silane group can be used in a crosslinker.

Another possibility of crosslinking acid functional groups is by use of multivalent metal ions by reaction of the aforementioned acid groups with a multivalent metal ion containing substance, such as zinc oxide.

Carboxylic acids could also be crosslinked in reactions with multifunctional olefinic unsaturated substances under catalysis of a strong acid. Multifunctional carbonates could also react with carboxylic acids to give ester linkages with liberation of carbon dioxide.

In the alternative, polyolefinic materials may be crosslinked via free radical crosslinking, initiated by addition of peroxides or via radiation, e.g., electron beam.

With respect to crosslinkable functional groups, one or more may be present in a crosslinking agent. In the alternative, two or more crosslinkable functional groups may be present in a single molecule.

The cross-linking agent having the above described crosslinkable functional group may be a waterdispersed or water-dispersible or water-soluble substance. In one embodiment, exemplary crosslinking agents include, but are not limited to, an aqueous monomeric or polymeric substance, which contains two or more oxazoline groups, carbodiimide groups, epoxy groups, isocyanate groups, methylol groups etc. or several of these per molecule.

An exemplary oxazoline crosslinking agent is an aqueous polymer having two or more oxazoline groups in its molecules, substances can be obtained by polymerizing an oxazoline group-containing monomer and, as required, an ethylenic unsaturated monomer. Alternatively an oxazoline crosslinking agent can also be obtained by reaction between a nitrile group and an aminoethanol group, dehydration of a hydroxylalkylamide group and the like.

Crosslinking agents having two or more carbodiimide groups can be produced from diisocyanate compounds by a condensation reaction accompanied by decarboxylation reaction of a diisocyanate compound. Examples of the diisocyanate compound include, but are not limited to, 1,5-naphthylene diisocyanate, 4,4'-diphenylmethane diisocyanate, 4,4'-diphenyldimethylmethane diisocyanate, 1,4-phenylene diisocyanate, 2,4-tolylene diisocyanate, 2,6-tolylene diisocyanate, hexanemethylene diisocyanate, cyclohexane-1,4-diisocyanate, xylylene diisocyanate, isophorone diisocyanate, dicyclohexylmethane-4,4'-diisocyanate, methylcyclohexane diisocyanate, and tetramethylxylylene diisocyanate and the like. These compounds may also be used as mixtures.

Monofunctional isocyanates may be included to control the resin molecular chain length such as phenyl isocyanate, tolyl isocyanate, cyclohexylisocyanate, dimethylphenyl isocyanate, butylisocyanate, and naphthyl isocyanate are useful.

Diisocyanate substances may be partially reacted with aliphatic compounds, alicyclic compounds, or aromatic compounds having a hydroxyl group, an imino group, an amino group, a carboxyl group, a mercapto group, an epoxy group, and the like.

In the condensation reaction accompanied by decarboxylation of a diisocyanate compound, a carbodiimidization catalyst can be used. Usable as such a catalyst are, for example, phospholene oxides such as 1-phenyl-2-phospholene-1-oxide,3-methyl-2-phospholene-1-oxide, 1-ethyl-2-phospholene-1-oxide, and 3-phospholene isomers thereof.

In order to convert a carbodiimide group-containing polymer into an aqueous polymer, a hydrophilic segment is provided in the molecular structure of the carbodiimide group-containing polymer. For example, an aqueous polymer containing a carbodiimide group can be obtained by providing a hydrophilic segment having a functional group which has reactivity with an isocyanate group. Usable as the hydrophilic segment are: quaternary ammonium salts of dialkylamino alkylamine (e.g., quaternary ammonium salts of 2-dimethylaminoethanol); quaternary salts of dialkylamino alkylamine (e.g., 3-dimethylamino-n-propylamine); alkyl sulfonic acid salts having at least one reactive hydroxyl group (e.g., sodiumhydroxypropanesulfonate); a mixture of polyethylene oxide or polyethylene oxide, whose terminal is capped with an alkoxy group, and a polypropylene oxide (e.g., polyethylene oxide whose terminal position is capped with a methoxygroup or an ethoxy group) As an aqueous cross-linking agent containing an epoxy group, there are exemplified sorbitol polyglycidyl ether, glycerol triglycidyl ether, polyglycerol polyglycidylether trimethylolpropane triglycidyl ether, poly(ethyleneglycol) diglycidyl ether, poly (propyleneglycol) diglycidyl ether, phenol ethyleneoxide glycidyl ether, and lauryl alcohol ethyleneoxide glycidyl ether or the like. In addition to the above, mentioned as examples are: a water-soluble epoxy resin obtained by reacting a carboxy compound, which is obtained through a reaction between a polyoxyethylene polyol compound and an acid anhydride compound, and an epoxy resin having two or more epoxy groups in its molecules; and a self-emulsifiable epoxy resin composition obtained by mixing the water-soluble epoxy resin and the epoxy resin having two or more epoxy groups in its molecules. Such resins can be obtained for example under the tradenames of XZ 92533.00, XZ 92598.00 and XZ 92446.00 from The Dow Chemical Company, Midland, Mich. Examples of the anhydride compound include, but not particularly limited to, preferably aromatic anhydrides such as phthalic anhydride, trimellitic anhydride, and pyromellitic anhydride; and cyclic aliphatic anhydrides such as maleic anhydride, succinic anhdyride, tetrahydrophthalic anhydride, methyl tetrahydrophthalic anhydride, methyl nadic anhydride, alkenyl succinic anhdyride, hexahydrophthalic anhydride, and methyl hexahydrophthalic anhydride. There is no limitation on the epoxy resin having two or more epoxy groups in its molecules, and all known epoxy resins with an epoxy functionality of greater or equal to two can be used. Examples are polyglycidyl ether obtained from epichlorohydrin and a polyhydric compound such as, phenol novolac, and cresol novolac bisphenol A, bisphenol F, bisphenol S, resorcinol, hydroquinone or catechin; alkylene oxide-added bisphenol A; polyalcohols such as polypropylene glycol, 1,6-hexanediol, trimethylol propane, glycerin, cyclohexanedimethanol; and polyglycidyl ester and polyglycidyl amine of polycarboxylic acids such as adipic acid, phthalic acid, dimer acid and the like.

Aqueous cross-linking agent containing an isocyanate group are, for example: polyisocyanate mainly containing at least one member selected from the group consisting of an isocyanurate group-containing polyisocyanate, an urethodione group-containing polyisocyanate, an urethodione group/isocyanurate group containing polyisocyanate, an urethane group containing polyisocyanate, an allophanate group containing polyisocyanate, a biuret group containing polyisocyanate, a carbodiimide group containing polyisocyanate, and an uretodione group containing polyisocyanate, each of which contains 1,6-hexamethylene diisocyanate and/or isophorone diisocyanate as a raw material; and a self-emulsifiable polyisocyanate obtained by reacting a hydrophilic surfactant having at least one active hydrogen group which can react with an isocyanate group or polyethylene ether alcohol containing at least three poly-ethylene oxide units with fatty acid ester in which the sum of the number of carbons of fatty acid and a hydroxyl containing compound as raw materials is 8 or more and which has at least one active hydrogen group which can react with an isocyanate group. In addition to the above, an urethane group-containing polyisocyanate obtained by reaction between 1,6-hexamethylenediisocyanate and/or an isophorone diisocyanate and an active hydrogen group-containing compound or polyisocyanate obtained by an allophanatization reaction, carbodiimidization reaction, uretodionization reaction, and biuretization reaction of these diisocyanate compounds can be mentioned.

Examples of suitable crosslinking agents containing an aldehyde are waterdispersed or waterdispersible or water-soluble phenol formaldehyde resins, amino formaldehyde resins or combinations thereof.

Phenol formaldehyde crosslinking agents include, but are not limited to, reaction products of aldehydes with phenols. Preferred aldehdydes but not exclusive are formaldehyde and acetaldehyde. A large variety of phenols can be used such as but not exclusive phenol, cresol, p-phenylphenol, p-tert-butylphenol, p-tert-amylphenol, cyclopentylphenol, cresylic acid, bisphenol-A, bisphenol-F and the like and combinations thereof. Also acid functional phenols could be used in making phenol formaldehyde resins. The cross-linkers can be unetherified or etherified with alcohols or polyols. These phenol formaldehyde resins may be soluble or self-emulsifiable in water or can be stabilized by use of colloid stabilizers such as polyvinyl alcohol.

Amino formaldehyde crosslinking agents include, but are not limited to, reaction products of aldehydes with amino or amido group containing molecules. Exemplary aldehydes include, but are not limited to, formaldehyde and acetaldehyde. A large variety of amino or amido group containing molecules can be used such as but not exclusive urea, melamine, benzoguanamine, acetoguanamine, glycoluril and the like. Suitable amino crosslinking resins include melamine-formaldehyde, urea-formaldehyde, benzoguanamine-formaldehyde, acetoguanamine-formaldehyde, glycoluril-formaldehyde resins. Also the methylol groups of an amino formaldehyde resin can be partially or fully etherified with at least one of the groups of monohydric aliphatic alcohols such as methanol and/or n-butanol. These amino formaldehyde resins may be soluble or self-emulsifiable in water or can be stabilized by use of colloid stabilizers such as polyvinyl alcohol can be used to stabilize the amino formaldehyde dispersions.

Commercially available amino-formaldehyde resins which are water soluble or water dispersible and useful for the instant purpose include Cymel™ 301, Cymel™ 303, Cymel™ 370, and Cymel™ 373 (all being products of Cytec Surface Specialties, Brussels, Belgium). Other aldehydes used to react with the amino compound to form the resinous material are crotonic aldehyde, acrolein, or compounds which generate aldehydes, such as hexamethylene-tetramine, paraldehyde, and the like.

Another class of crosslinking agents for carboxylic acid groups are water-soluble hydroxyalkylamide crosslinkers such as Bis(N,N'-dihydroxyethyl)adipamide and the like. Such compounds are commercially available under the tradename of PRIMID™ crosslinker resins from EMS-PRIMID in Switzerland, for example PRIMID™ XL-522, PRIMID™ SF-4510 and PRIMID™ QM-1260

The one or more crosslinking agents may be added to the aqueous dispersion as part of the aqueous dispersion formulation process; or in the alternative, the one or more crosslinking agents may be added to the aqueous dispersion post dispersion formulation process.

Depending on the type of food or beverage which is to be contained in a coated container, and on required coating properties it may be beneficial to combine several crossslinkers or some crosslinkers may be more suited than others. Some crosslinkers may not be suited for all applications. Some crosslinkers may require the addition of catalysts for proper cure.

Crosslinkers will help to build thermoset networks which is indicated by higher values of MEK Double Rubs compared to an identical formulation not containing the crosslinker.

Forming the Dispersion

The aqueous dispersion can be formed by any number of methods recognized by those having skill in the art. Dispersion equipment can be operated in batch, semi-batch, or continuous mode. Examples of mixers include rotor-stator, microfluidizer, high pressure homogenizer, ultrasonic, impinging jet, Cowles™ blade, planetary mixers, and melt kneading devices such as extruders.

In one embodiment, one or more base polymers, one or more stabilizing agents are melt-kneaded in an extruder along with water and optionally one or more neutralizing agents, such as ammonia, potassium hydroxide, amine, or a combination of two or more, to form a dispersion. In another embodiment, one or more base polymers and one or more stabilizing agent are compounded, and then melt-kneaded in an extruder in the presence of water, and optionally one or more neutralizing agents thereby forming a dispersion. In some embodiments, the dispersion is first diluted to contain about 1 to about 20%, e.g., 1 to 5% or 1 to 3%, by weight water and then, subsequently, further diluted to comprise greater than about 25% by weight water. In one embodiment, further dilution may be accomplished via a solvent.

Any melt-kneading means known in the art may be used. In some embodiments, a kneader, a BANBURY® mixer, single-screw extruder, or a multi-screw extruder, e.g. a twin screw extruder, is used. A process for producing the dispersions in accordance with the present invention is not particularly limited. For example, an extruder, in certain embodiments, for example, a twin screw extruder, is coupled to a back pressure regulator, melt pump, or gear pump. Exemplary embodiments also provide a base reservoir and an initial water reservoir, each of which includes a pump. Desired amounts of base and initial water are provided from the base reservoir and the initial water reservoir, respectively. Any suitable pump may be used, but in some embodiments, for example, a pump that provides a flow of about 150 cc/min at a pressure of 240 bar is used to provide the base and the initial water to the extruder. In other embodiments, a liquid injection pump provides a flow of 300 cc/min at 200 bar or 600 cc/min at 133 bar. In some embodiments, the base and initial water are preheated in a preheater.

One or more base polymers, in the form of pellets, powder, or flakes, are fed from the feeder to an inlet of the extruder where the resin is melted or compounded. One or more additional components may optionally be fed simultaneously with one or more base polymers into the extruder via the feeder; or in the alternative, one or more additional components may be compounded into one or more base polymers, and then fed into the extruder via the feeder. In the alternative, additional one or more additional components may optionally further be metered via an inlet prior to the emulsification zone into the molten compound comprising one or more base polymers. In some embodiments, the dispersing agent is added to one or more base polymers through and along with the resin and in other embodiments, the dispersing agent is provided separately to the twin screw extruder. The resin melt is then delivered from the mix and convey zone to an emulsification zone of the extruder where the initial amount of water and base from the water and base reservoirs are added through an inlet. In some embodiments, dispersing agent may be added additionally or exclusively to the water stream. In some embodiments, further dilution water may be added via water inlet from water reservoir in a dilution and cooling zone of the extruder. Typically, the dispersion is diluted to at least 30 weight percent water in the cooling zone. In addition, the diluted mixture may be diluted any number of times until the desired dilution level is achieved. In some embodiments, the dispersion is further cooled after exiting the extruder by the use of a suitable heat exchanger. In other embodiments, water is not added into the twin screw extruder but rather to a stream containing the resin melt after the melt has exited from the extruder. In this manner, steam pressure build-up in the extruder is eliminated and the dispersion is formed in a secondary mixing device such as a rotor stator mixer.

In another embodiment, the aqueous dispersion can be formed in a continuous high shear mixer without the use of a melt kneading extruder. In this embodiment, the first stream comprising one or more liquid or molten base polymers is supplied to a continuous high shear mixer from a suitable liquid pump for example, a syringe pump, gear pump, or progressive cavity pump. The first stream is flowed through a first conduit and merged continuously with a second stream containing a continuous aqueous phase that is flowed through a second conduit. The first and second streams are merged into a disperser in the presence of a stabilizing agent with optional neutralizing agent. The agents can be added to either the first or second stream, or as a separate stream. A third stream comprising water can be added downstream from the disperser. The flow rates of the streams are adjusted to achieve a dispersion having the desired amount of polymer phase and percent solids. The disperser can be any one of a number of continuous inline mixers, for example, an IKA high-shear mixer, Oakes rotor stator mixer, Ross mixer, Silverson mixer, or centrifugal pump. The rpm setting of the disperser can be used to help control the particle size of the dispersed hydrophobic phase in the dispersion. The system can be heated to provide the polymer and neutralizer components at a suitable viscosity for pumping. Steam formation is reduced by controlling the pressure through the use of a backpressure regulator, gear pump, metering pump, or other suitable device near the exit of the process. In some embodiments, the dispersion is further cooled after exiting the disperser by the use of a suitable heat exchanger.

In another embodiment, the aqueous dispersion can be formed in a batch or semi-batch high shear mixer where the mixer may, for example, be disposed within a pressurized tank to, for example, reduce steam formation. All or at least a portion of the dispersion is removed from the tank during processing, and optionally cooled by the use of a suitable heat exchanger.

During the preparation of the aqueous dispersion, optionally one or more fillers; optionally one or more additives such as catalysts, wetting agents, defoamers, flow agents, release agents, slip agents, anti-blocking agents, additives to mask sulfur staining, pigment wetting/dispersion agents, anti-settling agents, UV stabilizers, adhesion promoters; optionally one or more lubricants such as fatty acid ester wax, silicon-based wax, fluorine-based wax, polyethylene or any other similar polyolefin wax, carnauba wax, lanolin wax or the like; optionally one or more corrosion inhibitors such as aluminum, and zinc: optionally one or more pigments, e.g. titanium dioxide, mica, calcium carbonate, barium sulfate, silica, zinc oxide, milled glass, aluminum trihydrate, talc, antimony trioxide, fly ash, and clay or the like; optionally one or more dyes; optionally one or more co-solvents, e.g. glycols, glycol ether, 2,2,4-trimethyl-1,3-pentanediol monoisobutyrate, alcohols, mineral spirits, and benzoate esters or the like; optionally one or more dispersants, e.g. aminoalcohols, and polycarboxylates; optionally one or more surfactants; optionally one or more defoamers; optionally one or more preservatives, e.g. biocides, mildewcides, fungicides, algaecides, and combinations thereof, optionally one or more thickeners, e.g. cellulosic based thickeners such as hydroxyethyl cellulose, hydrophobically modified alkali soluble emulsions (HASE thickeners such as UCAR POLYPHOBE TR-116) and hydrophobically modified ethoxylated urethane thickeners (HEUR); or optionally one or more additional neutralizing agents, e.g. hydroxides, amines, ammonia, and carbonates may be added to the aqueous dispersion formulation; or in the alternative, may be added to the dispersion post dispersion formulation process.

During the preparation of the aqueous dispersion, one or more stabilizing agents may also be added to the aqueous dispersion formulation; or in the alternative, may be added to the dispersion post dispersion formulation process.

Optionally during the dispersion of the one or more base polymers another polymer dispersion or emulsion may be used as a portion of the aqueous phase of the dispersion. Examples include, but are not limited to, acrylic, epoxy, polyester, polyurethane, polyolefin, polyamide and the like containing dispersions, emulsions, suspensions, colloidal suspensions.

Coating Applications and Forming Coated Containers or Closure Devices

The aqueous dispersion may be used, for example, in container, e.g. can, coating application, or closure device coating application. Such coated container devices include, but are not limited to, cans such as beverage cans, food cans; aerosol containers such as those for non-food products, e.g. hair spray, hair dye, or color spray lacquers; drums; kegs; pails; decorative tins; open trays; tubes, bottles, monoblocs, and the like. The coated closure devices include, but are not limited to, caps, lids such as thin aluminum foil based lids for yogurt and butter containers, or crown corks; closures for glass jars and bottles such as roll-on closures, vacuum closures, pilfer-proof closures, easy peel lids for can closures, and easy open end or conventional ends for cans. Cans may be 2 piece cans or 3 piece cans. Beverage cans include, but are not limited to, beer cans, carbonated soft drink cans, energy drink cans, isotonic drink cans, water cans, juice cans, tea cans, coffee cans, milk cans, and the like. Food cans, include, but are not limited to, vegetable cans, fruit cans, meat cans, soup cans, ready meal cans, fish cans, edible oil cans, sauce cans and the like. Such cans may have any shapes; for example, such can may have a cylindrical shape, cubical, spherical, semi-spherical, bottle shape, elongated cubical shape, shallow or tall shape, round or rectangular shape or any other suitable shape. The coated container devices according to the instant invention may be formed via any conventional method. For example, the coated container device may be formed via stamping, drawing, redrawing, wall ironing, bending, beading, embossing, debossing, flanging, necking, stretching, blow-stretching and any other suitable conventional method. Such methods are generally known to those having ordinary skill in the art. The aqueous dispersion may, for example, be applied to a metal substrate, e.g. metal sheet or metal foil, and then the coated substrate may be formed into a coated container device or a coated closure device. In the alternative, the metal substrate may be formed into a container device or a closure device, and then the container device or the closure device is coated with one or more aqueous dispersions to form the coated container device or coated closure device. The coating may be applied via any method; for example, via roller coating, spray coating, powder coating, dip coating, electrodeposition coating, printing, wash coating, flow coating, curtain coating.

The one or more aqueous dispersions applied to the at least one surface of the metal substrate may be dried via any conventional drying method. Such conventional drying methods include but, are not limited to, air drying, convection oven drying, hot air drying, and/or infrared oven drying. During the drying process, crosslinking of one or more base polymers, stabilizing agents, or combinations thereof, involving one or more the crosslinking agents, may occur. Additional cure might occur by radiation cure, e.g. electron-beam cure. The one or more aqueous dispersions applied to the at least one surface of the metal substrate may be dried at any temperature; for example, it may be dried at a temperature in the range of equal or greater than the melting point temperature of the base polymer; or in the alternative, it may be dried at a temperature in the range of less than the melting point of the base polymer. The one or more aqueous dispersions applied to the at least one surface of the metal substrate may be dried at a temperature in the range of about 60° F. (15.5° C.) to about 700° F. (371° C.) for a period of less than about 40 minutes, for example, less than 20 minutes, or less than 10 minutes, or less than 5 minutes, or less than 2 minutes, or less than 1 minute, or less than 20 seconds. All individual values and subranges from about 60° F. (15.5° C.) to about 700° F. (371° C.) are included herein and disclosed herein; for example, the one or more aqueous dispersions applied to the at least one surface of the metal substrate may be dried at a temperature in the range of about 60° F. (15.5° C.) to about 500° F. (260° C.) for a period of less than about 40 minutes, for example, less than 20 minutes, or less than 10 minutes, or less than 5 minutes, or less than 2 minutes, or less than 1 minute, or in the alternative, the one or more aqueous dispersions applied to the at least one surface of the metal substrate may be dried at a temperature in the range of about 60° F. (15.5° C.) to about 450° F. (232.2° C.) for a period of less than about 40 minutes, for example, less than 20 minutes, or less than 10 minutes, or less than 5 minutes, or less than 2 minutes, or less than 1 minute. The temperature of the one or more aqueous dispersions applied to the at least one surface of the metal substrate may be raised to a temperature in the range of equal or greater than the melting point temperature of the base polymer for a period of less than about 40 minutes. All individual values and subranges from less than about 40 minutes are included herein and disclosed herein; for example, the temperature of the one or more aqueous dispersions applied to the at least one surface of the metal substrate may be raised to a temperature in the range of equal or greater than the melting point temperature of the base polymer for a period of less than about 20 minutes, or in the alternative, the temperature of the one or more aqueous dispersions applied to the at least one surface of the metal substrate may be raised to a temperature in the range of equal or greater than the melting point temperature of the base polymer for a period of less than about 5 minutes, or in another alternative, the temperature of the one or more aqueous dispersions applied to the at least one surface of the metal substrate may be raised to a temperature in the range of equal or greater than the melting point temperature of the base polymer for a period in the range of about 0.5 to 300 seconds. In another alternative, the temperature of the one or more aqueous dispersions applied to the at least one surface of the metal substrate may be raised to a temperature in the range of less than the melting point temperature of the base polymer for a period of less than 40 minutes. All individual values and subranges from less than about 40 minutes are included herein and disclosed herein; for example, the temperature of the one or more aqueous dispersions applied to the at least one surface of the metal substrate may be raised to a temperature in the range of less than the melting point temperature of the base polymer for a period of less than about 20 minutes, or in the alternative, the temperature of the one or more aqueous dispersions applied to the at least one surface of the metal substrate may be raised to a temperature in the range of less than the melting point temperature of the base polymer for a period of less than about 5 minutes, or in another alternative, the temperature of the one or more aqueous dispersions applied to the at least one surface of the metal substrate may be raised to a temperature in the range of less than the melting point temperature of the base polymer for a period in the range of about 0.5 to 300 seconds.

The coated metal substrate may further be coated with one or more conventional coating compositions, or it may further be laminated to one or more other layers. Such conventional coating compositions are generally known to person of ordinary skill in the art, and they may include, but are not limited to, epoxy resin coating compositions, acrylate based coating compositions, and polyester based coating compositions. The lamination process is generally known, and exemplary lamination layers may include, but are not limited to, polyester laminates, polyolefin based laminates such as polypropylene laminates.

The one or more aqueous dispersions applied to at least one surface of a metal substrate, for example a pre-coated substrate, as one or more crosslinked coating layers may have a cross cut adhesion rating of at least 3B; for example, 5B, measured according to ASTM-D 3359-08. The one or more aqueous dispersions applied to at least one surface of a metal substrate as one or more crosslinked coating layers may a methyl ethyl ketone (MEK) double rub rating of at least 10. The one or more aqueous dispersions applied to at least one surface of a metal substrate as one or more crosslinked coating layers may have a wedge bend pass rating of at least 90 percent, measured via a Gardner "COVERALL" Bend Tester IG 1125.

EXAMPLES

The following examples illustrate the present invention but are not intended to limit the scope of the invention. The examples of the instant invention demonstrate that the one or more aqueous dispersions applied to at least one surface of a metal substrate provide for improved coating layer flexibility as well as coating layer adhesion to the metal substrate.

Preparation of Inventive Aqueous Dispersion A

Aqueous dispersion A was prepared according to the following procedures based on the formulation components listed in Table I. PRIMACOR™ 1410 (CAS No. 9010-77-9), ethylene acrylic-acid copolymer having acrylic acid content of approximately in the range of 9 to 10 weight percent and a melt index of approximately in the range of 1.3 to 1.6 g/10 minutes (ASTM D 1238, 190 deg C./2.16 Kg), available from The Dow Chemical Company, as the base polymer, and PRIMACOR™ 5980i (CAS No. 9010-77-9), ethylene acrylic-acid copolymer having acrylic acid content of approximately in the range of 19.5 to 21.5 weight percent and a melt index of approximately 300 g/10 minutes (ASTM D 1238, 190 deg C./2.16 Kg), available from The Dow Chemical Company, as the stabilizing agent were fed into a 25 mm diameter twin screw extruder by means of a controlled rate feeder where they were forwarded and melted. The extruder temperature profile was ramped up to approximately 160° C. prior to the addition of the initial water and AMP-95, amino-2-methyl-1-propanol (95%) (CAS No. 124-68-5), as the neutralizing agent, and subsequently, it was cooled back down to a temperature below 100° C. by the end of the extruder after the dilution water was added. The extruder speed was approximately 450 rpm. Amine base and water were mixed together and fed to the extruder at the initial water introduction point. The dilution water was fed via a second pump, and it was introduced into the dilution zone of the extruder. The initial water and dilution water streams were optionally pre-heated to the extruder temperature. At the extruder outlet, a back-pressure regulator was used to adjust to a suitable pressure inside the extruder barrel to reduce steam formation at the operating temperature. The resulting dispersions were cooled and filtered through a 200 micron filter.

Preparation of Inventive Aqueous Dispersion B Aqueous dispersion B was prepared according to the following procedures based on the formulation components listed in Table I. PRIMACOR™ 1321 (CAS No. 9010-77-9), ethylene acrylic-acid copolymer having acrylic acid content of approximately in the range of 6 to 7 weight percent and a melt index of approximately in the range of 2.2 to 2.8 g/10 minutes, available from The Dow Chemical Company, as the base polymer, and HDPE 30460M (CAS No. 26211-73-8), a high density polyethylene with a density of approximately in the range of 0.958 to 0.962 g/cm$^3$ and a melt index of approximately in the range of 24 to 36 g/1 minutes, available from The Dow Chemical Company, as additional base polymer, and PRIMACOR™ 5980i (CAS No. 9010-77-9), ethylene acrylic-acid copolymer having acrylic acid content of approximately in the range of 19.5 to 21.5 weight percent and a melt index of approximately in the range of 300 g/10 min (ASTM D 1238, 190 deg C./2.16 Kg), available from The Dow Chemical Company, as the stabilizing agent were fed into a 25 mm diameter twin screw extruder by means of a controlled rate feeder where they were forwarded and melted. The extruder temperature profile was ramped up to approximately 160° C. prior to the addition of the initial water and AMP-95, amino-2-methyl-1-propanol (95%) (CAS No. 124-68-5), as the neutralizing agent, and subsequently, it was cooled back down to a temperature below 100° C. by the end of the extruder after the dilution water was added. The extruder speed was approximately 450 rpm. Amine base and water were mixed together and fed to the extruder at the initial water introduction point. The dilution water was fed via a second pump, and it was introduced into the dilution zone of the extruder. The initial water and dilution water streams were optionally pre-heated to the extruder temperature. At the extruder outlet, a back-pressure regulator was used to adjust to a suitable pressure inside the extruder barrel to reduce steam formation at the operating temperature. The resulting dispersions were cooled and filtered through a 200 micron filter.

Preparation of Inventive Aqueous Dispersion C

Aqueous dispersion C was prepared according to the following procedures based on the formulation components listed in Table I. PRIMACOR™ 1321 (CAS No. 9010-77-9), ethylene acrylic-acid copolymer having acrylic acid content of approximately in the range of 6 to 7 weight percent and a melt index of approximately in the range of 2.2 to 2.8 g/10 minutes (ASTM D 1238, 190 deg C./2.16 Kg) available from The Dow Chemical Company, as the base polymer, and PRIMACOR™ 5980i (CAS No. 9010-77-9), ethylene acrylic-acid copolymer having acrylic acid content of approximately in the range of 19.5 to 21.5 weight percent and a melt index of approximately 300 g/10 minutes (ASTM D 1238, 190 deg C./2.16 Kg), available from The Dow Chemical Company, as the stabilizing agent were fed into a 25 mm diameter twin screw extruder by means of a controlled rate feeder where they were forwarded and melted. The extruder temperature profile was ramped up to approximately 160° C. prior to the addition of the initial water and DMEA, 2-dimethyl amino ethanol (100%) (CAS No. 108-01-0), as the neutralizing agent, and subsequently, it was cooled back down to a temperature below 100° C. by the end of the extruder after the dilution water was added. The extruder speed was approximately 450 rpm. Amine base and water were mixed together and fed to the extruder at the initial water introduction point. The dilution water was fed via a second pump, and it was introduced into the dilution zone of the extruder. The initial water and dilution water streams were optionally pre-heated to the extruder temperature. At the extruder outlet, a back-pressure regulator was used to adjust to a suitable pressure inside the extruder barrel to reduce steam formation at the operating temperature. The resulting dispersions were cooled and filtered through a 200 micron filter.

Preparation of Inventive Aqueous Dispersion D

Dispersion D was prepared in a manner similar to dispersion A, but with the formulation components listed in Table I.

Preparation of Supplemental Inventive Aqueous Dispersions S1-28

Supplemental Inventive Dispersions S1-28 were prepared in a manner similar to dispersion A, but with the formulation components listed in Table I.

Preparation of Coatings Based on Formulations with Melamine Formaldehyde Crosslinker Dispersions A-D were mixed with Cymel™ 327 (CAS No. 9003-08-1), melamine formaldehyde resin, available from Cytec Surface Specialties, Brussels, Belgium as a crosslinking agent in a beaker using a IKA RW 16 electrical stirring agitator at level 5 with a R-1302 stirrer at room temperature, approximately 25° C., for about one minute to yield the finished formulation. The mixture is allowed to sit until bubbles dissipate. The details of the coating formulations based on the combination of aqueous dispersions A-D and Cymel™ 327, as crosslinking agent, are reported in Table II.

Preparation of Coatings Based on Formulations with Phenolic Crosslinker

Inventive Formulation Example 5

Step 1: Preparation of the Phenolic Crosslinker Blend Dispersion:

20 g of XZ 95320.02 experimental epoxy curing agent, 20 g of Phenodur™ PR 401 phenolic resin and 0.75 g of dimethyl ethanol amine were mixed under stirring with an IKA RE-166 electric stirring agitator and a propeller-blade stirrer at about 2000 rpm. Then 18.0 g of water was added slowly under stirring until a phase inversion occurred. The resulting emulsion had a solids content of 41.1%.

XZ 95320.02 experimental epoxy curing agent is available from The Dow Chemical Company., Midland Mich. Phenodur™ PR 401 phenolic resin is available from Cytec Surface Specialties, Brussels, Belgium Step 2: Preparation of the Final Formulation 25.46 g of the inventive dispersion D are mixed with 4.44 g of the phenolic crosslinker dispersion of above in a beaker using an IKA RW 16 electrical stirring agitator at level 5 with a R-1302 stirrer at room temperature, approximately 25° C., for about one minute to yield the finished formulation.

Step 3: A tin plate panel, provided by Rasselstein, having grade TS-245 standard finish, with approximately 10 cm to 20 cm size was cleaned with acetone, and then dried. About 3 grams of the coating formulation was applied to the tin plate panel via a 30 micron spiral drawdown bar thereby coating one surface of the tin plate panel. Subsequently, the panel was placed into a convection oven to be cured at 200° C. for 3 minutes. The coating was slightly hazy. The details of the coating formulation are listed in Table III.

Inventive Formulation Example 6

Preparation of Coatings with Acrylic Resin Composition

Step 1: Dimethyl amino ethanol was mixed with water to form a 50% aqueous solution.

Step 2: 2.14 g of the aqueous dimethyl amino ethanol solution (50%) of step 1 were slowly added to 4.65 gr of PRIMAL™ E 3203 acrylic emulsion in a beaker using a IKA RW 16 electrical stirring agitator at level 5 with a R-1302 stirrer at room temperature, approximately 25° C., for about one minute. A high viscosity dispersion was obtained.

Step 3: PRIMID™ XL 552 crosslinker was dissolved in water to form a 50% aqueous solution.

Step 4: 6.72 g of the resulting mixture of step 2 were mixed with 24.48 of dispersion D in a beaker using a IKA RW 16 electrical stirring agitator at level 5 with a R-1302 stirrer at room temperature, approximately 25° C., for about one minute. Then 2 g of the PRIMID™ XL-552 solution (50%) of step 3 was added using a IKA RW 16 electrical stirring agitator at level 5 with a R-1302 stirrer at room temperature, approximately 25° C., for about one minute.

PRIMAL™ E-3203 is available from The Dow Chemical Company, Midland, Mich.; PRIMID™ XL 552 is available from EMS Chemie, Donat; Switzerland.

A tin plate panel, provided by Rasselstein, having grade TS-245 standard finish, with approximately 10 cm to 20 cm size was cleaned with acetone, and then dried. About 3 grams of the coating formulation was applied to the tin plate panel via a 30 micron spiral drawdown bar thereby coating one surface of the tin plate panel. Subsequently, the panel was placed into a convection oven to be cured at 200° C. for 3 and 6 minutes. The details of the coating results are listed in Table IV.

Inventive Formulation Example 7

1.74 g of XZ 92546.00 experimental epoxy novolac emulsion at 57.5% nv were mixed with 31.47 g of inventive dispersion D in a beaker using a IKA RW 16 electrical stirring agitator at level 5 with a R-1302 stirrer at room temperature, approximately 25° C., for about one minute to yield the finished formulation.

A tin plate panel, provided by Rasselstein, having grade TS-245 standard finish, with approximately 10 cm to 20 cm size was cleaned with acetone, and then dried. About 3 grams of the coating formulation was applied to the tin plate panel via a 30 micron spiral drawdown bar thereby coating one surface of the tin plate panel. Subsequently, the panel was placed into a convection oven to be cured at 200° C. for 3 minutes. The details of the coating results are listed in Table V.

Preparation of a Tinplate Panel Coated with a Polyester Resin Formulation 23.28 g of Dynapol™ 952 polyester and 3.98 g of SFC 112/65 from SI group were mixed with 43.23 g of a mixture of 52 parts by weight Solvesso™ 100 aromatic solvent and 48 parts by weight of Dowanol™ PMA glycol ether in a sealed glass bottle, which was rotating on an array of rotating bars at room temperature for 72 hours. Then 0.181 g of phosphoric acid (25% in Downanol™ glycol ether) were added and the glass was rotated for additional 24 hrs. Dynapol is a trademark of Evonik. Solvesso is a trademark of ExxonMobil, Dowanol is a trademark of The Dow Chemical Company.

A tin plate panel, provided by Rasselstein, having grade TS-245 standard finish, with approximately 10 cm to 20 cm size was cleaned with acetone, and then dried. About 3 grams of the coating formulation was applied to the tin plate panel via a 30 micron spiral drawdown bar thereby coating one surface of the tin plate panel. Subsequently, the panel was placed into a convection oven to be cured at 200° C. for 10 minutes. The coating had a thickness of 3.9 microns and 15 MEK DR.

Coating Application on a Pre-Coated Panel

The tin plate panel, coated with the polyester based formula, of above was used with out further cleaning. About 3 grams of the inventive coating formulation 4 was coated onto the polyester coating via a 30 micron spiral drawdown bar. Subsequently, the panel was placed into a convection oven to be cured for 3 minutes at 200° C.

The coated tin plate panels were tested for coating thickness, wedge bend, MEK DR (methyl ethyl ketone double rub) cross cut adhesion before sterilization, and cross cut adhesion and blush after sterilization in water according to the procedures described below. The results are reported in Table VI.

Coating Application of Uncoated Panels

A tin plate panel, provided by Rasselstein, having grade TS-245 standard finish, with approximately 10 cm to 20 cm size was cleaned with acetone, and then dried. About 3 grams of the inventive coating formulations 1-3 were applied individually to the tin plate panel via a 30 micron spiral drawdown bar thereby coating one surface of the tin plate panel. Subsequently, the panel was placed into a convection oven to be cured. The curing conditions are reported in Table VII.

The coated tin plate panels were tested for coating thickness, wedge bend, MEK DR (methyl ethyl ketone double rub) cross cut adhesion before sterilization, and cross cut adhesion and blush after sterilization according to the procedures described below. The results are reported in Table VII.

Comparative Experiment

A tin plate panel, provided by Rasselstein, having grade TS-245 standard finish, with approximately 10 cm to 20 cm size was cleaned with acetone, and then dried. About 3 grams of an inventive dispersion listed in Table IV was applied to the tin plate panel via a 30 micron spiral drawdown bar thereby coating one surface of the tin plate panel. Subsequently, the panel was placed into a convection oven to be cured. The curing conditions and testing results are reported in Table VIII.

The coated tin plate panels were tested for coating thickness, wedge bend, MEK DR (methyl ethyl ketone double rub) cross cut adhesion before sterilization, and cross cut adhesion and blush after sterilization in water according to the procedures described below.

Test Methods

Test Methods Include the Following:

Cross-Cut Adhesion

Cross-cut adhesion is measured according to ASTM-D 3359-08, Measuring adhesion by tape test, Method B., using an Erichsen cross-cut tester EPT 675R. This method provides the procedure for assessing the adhesion of coating films to metallic substrates by applying and removing a tape (grade: TESA 4124 clear) over the cuts made in the film. Place the center of a piece of tape over the grid and in the area of the grid smooth into place by a finger. To ensure good contact with the film rub the tape firmly. Within 90±30 seconds of application, remove the tape by seizing the free end and rapidly (not jerked) pulling it off at as close to an angle of 180 degrees as possible. Inspect the grid area for removal of coating from the substrate or from a previous coating using the illuminated magnifier. Rate the adhesion in accordance with the following scale.

| | |
|---|---|
| 5B | The edges of the cuts are completely smooth; none of the squares of the lattice is detached. |
| 4B | Small flakes of the coating are detached at intersections; less than 5% of the area is affected. |
| 3B | Small flakes of the coating are detached along the edges and at intersections of cuts. The area affected is 5-15% of the lattice. |
| 2B | The coating has flaked along the edges and on parts of the squares. The area affected is 15-35% of the lattice. |
| 1B | The coating has flaked along the edges of cuts in large ribbons and whole squares have detached. The area affected is 35-65% of the lattice. |
| 0B | Flaking and detachment is worse than 1B |

Sterilization in Water

The coated panels were immersed in water in a pressurizable metal container, and placed into a Steriliser Automat V where it was retorted at 129° C. for 30 minutes. Subsequently, the pressurized container was placed into a containment vessel with cold water, and the temperature of pressurized container was lowered to a temperature in the range of less than 50° C. before opening. The panels were removed, and dried. The blush appearance was then rated. Blush is called a whitish appearance of the coating. If the coating does not show any blush, then the rating is no blush; otherwise, it will be rated as very slight blush, slight blush, blush or strong blush.

Sterilization in Lactic Acid

The coated panels were immersed in 2% lactic acid solution in a pressurizable metal container, and placed into a Steriliser Automat V where it was retorted at 121° C. for 30 minutes. Subsequently, the pressurized container was placed into a containment vessel with cold water, and the temperature of pressurized container was lowered to a temperature in the range of less than 50° C. before opening. The panels were removed, and dried. The blush appearance was then rated. Blush is called a whitish appearance of the coating. If the coating does not show any blush, then the rating is no blush; otherwise, it will be rated as very slight blush, slight blush, blush or strong blush.

MEK Double Rub

The flat end of a hemispherical hammer having a weight of 1230±10 g was used. A normal tissue "VILEDA 3168" was bound around the hammer end. It was soaked with methyl ethyl ketone (MEK). The hammer was brought into contact with the coating, and moved forth-and-back over the whole coating, wherein one movement forth-and-back over the whole coating is considered one double rub. No additional pressure was applied onto the hammer. After every 10 double rubs, the tissue was re-soaked. The double rub step was repeated until the coating was rubbed off, i.e. at least a portion of the metal substrate was exposed. In the event that the double rub step reached 100 double rubs, the testing was terminated, and 100 double rubs were reported as the final results.

Wedge Bend

Wedge bend was measured via Gardner "COVERALL" Bend Tester IG 1125. The apparatus used for this test consists of two parts to convert it to a bending machine. A steel rod (mandrel) is mounted at the front of the base. The coated test panel of 100 mm width was flexed over the 3 mm rod mandrel; thus, the coating appears on the outside of the bend. The flexed panel was inserted in the wedge mandrel. The impactor, i.e. a metal weight, was raised to 7 inches height, and then dropped. The impactor is retrieved on its first bounce, and secured. The cylindrical fold in the panel was squeezed into a conical shape. The edge of the coated panel was rubbed with a solution of copper sulfate (mixture of 10 grams of copper sulfate, 90 grams of water and 3 grams of sulfuric acid). Anywhere the coating had been cracked; dark spots appeared, indicating failure. The length of the intact area along the length of the wedge bend, which is 100 mm, was measured in millimeters and expressed as percent pass.

Coating Thickness

Coating thickness was measured according to ASTM-D 1186-01, Non-destructive measurement of dry film thickness of non magnetic coatings applied to a ferrous base, using a PERMASCOPE D-211D, coating thickness gauge. The standard panel without any coating was used for calibration. The thickness of the coating of the coated panels were the average of 10 measurements, wherein each measurement of the thickness of the coating of the coated panels was measured using a probe for ferrous materials relative to the thickness of the coating of the standard panel, i.e. zero. The measured thickness was reported in microns.

Degree of Neutralization

The percent neutralization was the calculated amount of acrylic acid groups in the resin melt that are neutralized by the base.

Particle Size Measurement

The particle size was measured by a Coulter LS-230 particle size analyzer (Beckman Coulter Corporation).

Measurement Percent Solids

The percent solid was measured using a microwave solids analyzer.

The present invention may be embodied in other forms without departing from the spirit and the essential attributes thereof, and, accordingly, reference should be made to the appended claims, rather than to the foregoing specification, as indicating the scope of the invention.

TABLE I

| Aqueous Dispersion | Base Polymer (g/min) | Stabilizing Agent (g/min) | Additional Base Polymer (g/min) | Neutralizing Agent (ml/min) | Initial Water Rate (ml/min) | Dilution Water Rate (ml/min) | Average Particle Size Diameter (microns) |
|---|---|---|---|---|---|---|---|
| A | PRIMACOR ™ 1410 (49) | PRIMACOR ™ 5980i (21) | None | AMP-95 ™ (12.4) | 33 | 130 | 0.4 |
| B | PRIMACOR ™ 1321 (18.8) | PRIMACOR ™ 5980i (25) | HDPE 30460M (6.2) | AMP-95 ™ (8.5) | 12 | 160 | 0.8 |
| C | PRIMACOR ™ 1321 (35) | PRIMACOR ™ 5980i (15) | None | DMEA (7.2) | 25 | 95 | 1.2 |
| D | PRIMACOR ™ 1410 (47.6) | PRIMACOR ™ 5980i (20.4) | None | DMEA (11.2) | 33 | 120 | 0.3 |
| S1 | 109MFR Exp polypropylene (52.9) | PRIMACOR ™ 5980i (22.7) | none | DMEA (7.55) | 20.6 | 80 | 2.1 |
| S2 | 109MFR Exp polypropylene (52.9) | PRIMACOR ™ 5980i (17.0) | EPOLENE ™ E-25 (5.7) | DMEA (6.08) | 19 | 80 | 2.0 |
| S3 | D118.01 polypropylene (47.3) | PRIMACOR ™ 5980i (22.7) | EPOLENE ™ E-25 (5.7) | DMEA (7.79) | 24.68 | 80 | 8.85 |
| S4 | PRIMACOR ™ 1321 (42) | PRIMACOR ™ 5980i (18) | None | AMP-95 ™ (13.5) | 30 | 102 | 0.7 |
| S5 | PRIMACOR ™ 1321 (25.7) | PRIMACOR ™ 5980i (7.5) | HDPE 30460M (3.8) | DMEA (3.1) | 17 | 50 | 1.3 |
| S6 | PRIMACOR ™ 1321 (26.9) | PRIMACOR ™ 5980i (7.5) | HDPE 30460M (4.0) | DMEA (5.8) | 17 | 35 | 1.7 |
| S7 | PRIMACOR ™ 1410 (45.8) | PRIMACOR ™ 5980i (19.3) | None | DMEA (11.4) | 32 | 94 | 1.2 |
| S8 | PRIMACOR ™ 1410 (45) | PRIMACOR ™ 5980i (15) | None | DMEA (15.2) | 30 | 115 | 0.9 |
| S9 | PRIMACOR ™ 1410 (30) | PRIMACOR ™ 5980i (30) | None | DMEA (13) | 29 | 100 | 0.3 |
| S10 | PRIMACOR ™ 1430 (80) | PRIMACOR ™ 5980i (20) | None | DMEA (9.8) | 50 | 160 | 0.3 |
| S11 | PRIMACOR ™ 1430 (80) | PRIMACOR ™ 5990 (20) | None | DMEA (9.8) | 49 | 173 | 0.3 |
| S12 | PRIMACOR ™ 3150 (29) | PRIMACOR ™ 5980i (20) | None | DMEA (6.8) | 20 | 55 | 1.5 |
| S13 | PRIMACOR ™ 3440 (42) | PRIMACOR ™ 5980i (18) | None | AMP-95 ™ (10.4) | 30 | 114 | 0.55 |
| S14 | PRIMACOR ™ 3460 (48) | PRIMACOR ™ 5980i (12) | None | AMP-95 ™ (8.6) | 30 | 102 | 0.35 |
| S15 | HDPE 30460M (35) | PRIMACOR ™ 5980i (35) | None | AMP-95 ™ (19.4) | 20 | 220 | 1.0 |
| S16 | HDPE DMDA-8965 (30) | PRIMACOR ™ 5980i (20) | None | DMEA (10) | 17 | 64 | 0.8 |
| S17 | 6D43 polypropylene (79.4) | PRIMACOR ™ 5980i (25.5) | LICOCENE ™ 6452 (8.5) | DMEA (9.64) | 24.7 | 110 | 1.0 |
| S18 | 6D43 polypropylene (52.9) | PRIMACOR ™ 5980i (17.0) | LICOCENE ™ 6452 (5.7) | DMEA (6.35) | 14.31 | 80 | 0.84 |

TABLE I-continued

| Aqueous Dispersion | Base Polymer (g/min) | Stabilizing Agent (g/min) | Additional Base Polymer (g/min) | Neutralizing Agent (ml/min) | Initial Water Rate (ml/min) | Dilution Water Rate (ml/min) | Average Particle Size Diameter (microns) |
|---|---|---|---|---|---|---|---|
| S19 | 6D43 polypropylene (61) | PRIMACOR ™ 5980i (5.7) and behenic acid (3.0) | LICOCENE ™ 6452 (5.7) | DMEA (4.01) | 12.84 | 75 | 2.48 |
| S20 | 6D43 polypropylene (52.9) | PRIMACOR ™ 5980i (11.3) | LICOCENE ™ 6452 (11.3) | DMEA (4.99) | 13.02 | 83 | 1.45 |
| S21 | 6D43 polypropylene (52.9) | PRIMACOR ™ 5980i (22.7) | none | AMP-95 ™ (6.07) | 19.97 | 85 | 2.57 |
| S22 | 6D43 polypropylene (52.9) | PRIMACOR ™ 5990 (22.7) | none | 28% Ammonia (5.13) | 16.79 | 70 | 3.67 |
| S23 | 6D43 polypropylene (52.9) | PRIMACOR ™ 5980i (22.7) | none | 1,2 diaminopropane (2.72) | 14.93 | 70 | 2.29 |
| S24 | 6D43 polypropylene (52.9) | NUCREL ™ 2806 (22.7) | none | DMEA (6.6) | 17.87 | 90 | 1.06 |
| S25 | 6D43 polypropylene (52.9) | NUCREL ™ 2806 (22.7) | none | 1,2 diaminopropane (2.93) | 14.88 | 80 | 1.37 |
| S26 | 6D43 polypropylene (52.9) | PRIMACOR ™ 5980i (17.0) | EPOLENE ™ E-25 (5.7) | DMEA (6.05) | 18.98 | 80 | 1.98 |
| S27 | 6D43 polypropylene (52.9) | PRIMACOR ™ 5980i (17.0) | PRIMACOR ™ 3340 (5.7) | DMEA (5.3) | 14.33 | 80 | 2.59 |
| S28 | 6D43 polypropylene (47.3) | PRIMACOR ™ 5980i (22.7) | EXXELOR ™ PO1020 (5.7) | DMEA (7.75) | 23.25 | 80 | 1.6 |

TABLE II

| Coating Formulation | Dispersion | nv [%] *of Dispersion | Crosslinking Agent | nv [%]* of Crosslinking Agent | Dispersion Weight [grams] | Crosslinking Agent Weight [grams] | Total Weight of Formulation [grams] | nv [%]* of formulation |
|---|---|---|---|---|---|---|---|---|
| 1 | A | 33.3 | Cymel ™ 327 | 90 | 30.03 | 0.58 | 30.61 | 34.4 |
| 2 | B | 29.3 | Cymel ™ 327 | 90 | 34.13 | 0.58 | 34.71 | 30.3 |
| 3 | C | 29.6 | Cymel ™ 327 | 90 | 33.78 | 0.58 | 34.36 | 30.6 |
| 4 | D | 28.6 | Cymel ™ 327 | 90 | 33.22 | 0.56 | 33.78 | 29.6 |

*nv = non-volatiles or solid content

Phenolic Crosslinker Cured

TABLE III

| Coated Substrate | Formulation Example | cure condition [° C./min] | Total coating thickness average [microns] | cross cut adhesion loss before sterilization | cross cut adhesion loss after sterilization in water | blush after sterilization in water | wedge bent [% pass] | MEK DR | cross cut adhesion loss after sterilization in lactic acid | blush after sterilization in lactic acid |
|---|---|---|---|---|---|---|---|---|---|---|
| 10 | 5 | 200/3 | 5.9 | 5B | 5B | no blush | 100% | 100 | 5B | no blush |

Blend with Acrylic Resin

TABLE IV

| Coated Substrate | Inventive Dispersion | cure condition [° C./min] | Coating thickness average [microns] | cross cut adhesion loss before sterilization | cross cut adhesion loss after sterilization in water | blush after sterilization in water | wedge bent [% pass] | MEK DR | cross cut adhesion loss after sterilization in lactic acid | blush after sterilization lactic |
|---|---|---|---|---|---|---|---|---|---|---|
| 11 | 6 | 200/3 | 5.4 | 5B | 5B | no blush | 100% | 100 | 5B | slight blush |
| 12 | 6 | 200/6 | 5.9 | 5B | 5B | no blush | 100 | 100 | 5B | very slight blush |

Blend with Epoxy

TABLE V

| Coated Substrate | Inventive Dispersion | cure condition [° C./min] | Coating thickness average [microns] | cross cut adhesion loss before sterilization | cross cut adhesion loss after sterilization in water | blush after sterilization in water | wedge bent [% pass] | MEK DR | cross cut adhesion loss after sterilization in lactic acid | blush after sterilization in lactic acid |
|---|---|---|---|---|---|---|---|---|---|---|
| 13 | 7 | 200/3 | 5.5 | 5B | 5B | no blush | 100% | 100 | 5B | slight blush |

Overcoated Polyester Coated Panel

TABLE VI

| Coated Substrate | Formulation Example | cure condition [° C./min] | Total coating thickness average [microns] | cross cut adhesion loss before sterilization | cross cut adhesion loss after sterilization in water | blush after sterilization in water | wedge bent [% pass] | MEK DR |
|---|---|---|---|---|---|---|---|---|
| 9 | 4 | 200/3 | 8.0 | 5B | 5B | no blush | 100% | 63 |

TABLE VII

| Coated Substrate | Formulation Example | Cure Condition [° C./min] | Coating Thickness Average [microns] | Crosscut Adhesion Loss Before Sterilization in Water | Crosscut Adhesion Loss After Sterilization in Water | Blush After Sterilization in Water | Wedge Bent [% pass] | MEK DR |
|---|---|---|---|---|---|---|---|---|
| 1 | 1 | 200/3 | 4.4 | 5B | 5B | no blush | 100% | 56 |
| 2 | 2 | 200/3 | 3.9 | 5B | 5B | no blush | 100% | 30 |
| 3 | 3 | 200/3 | 5.6 | 5B | 5B | no blush | 100% | >100 |
| 4 | 1 | 150/5 | 4.3 | 5B | 5B | no blush | 100% | 99 |
| 5 | 2 | 150/5 | 3.9 | 5B | 5B | no blush | 100% | 50 |
| 6 | 3 | 150/5 | 5.2 | 4B | 4B | no blush | 100% | >100 |

TABLE VIII

| Coated Substrate | Formulation Example | cure condition [° C./min] | Coating thickness average [microns] | cross cut adhesion loss before sterilization | cross cut adhesion loss after sterilization in water | blush after sterilization in water | wedge bent [% pass] | MEK DR |
|---|---|---|---|---|---|---|---|---|
| 7 | A | 150/5 | 5.0 | 5B | 5B | no blush | 100% | 23 |
| 8 | D | 200/3 | 5.0 | 5B | 5B | Slight blush | 100% | 27 |

We claim:

1. A coated container device or a coated closure device comprising:

a metal substrate; and one or more crosslinked coating layers associated with said metal substrate, and wherein one or more crosslinked coating layers are derived from the application of one or more aqueous dispersions to at least one surface of said metal substrate, and wherein said one or more aqueous dispersions comprise;

the melt blending product of;

a base polymer, wherein said base polymer comprises a thermoplastic polyolefin polymer, having a polar group as either a comonomer or grafted monomer; and a stabilizing agent, wherein the stabilizing agent is a polar polyolefin in the presence of water and a stoichiometric excess of a neutralizing agent in an extruder; and one or more crosslinking agents, with the proviso that the base polymer has a lower acid number, measured according to ASTM D-974, than the stabilizing agent; and wherein a particle size of a dispersed hydrophobic phase in the aquesous dispersion is equal to or greater than 1.2 microns.

* * * * *